US009272872B2

(12) United States Patent
Sugiyama et al.

(10) Patent No.: US 9,272,872 B2
(45) Date of Patent: Mar. 1, 2016

(54) SHEET STACKING DEVICE AND PRINTING APPARATUS

(71) Applicant: CANON KABUSHIKI KAISHA, Tokyo (JP)

(72) Inventors: Noriyuki Sugiyama, Kawasaki (JP); Hiroyuki Saito, Yokohama (JP); Yasuyuki Asai, Tokyo (JP); Atsushi Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/611,506

(22) Filed: Feb. 2, 2015

(65) Prior Publication Data

US 2015/0239702 A1 Aug. 27, 2015

(30) Foreign Application Priority Data

Feb. 26, 2014 (JP) ..... 2014-035850

(51) Int. Cl.
*B65H 31/34* (2006.01)
*B65H 31/26* (2006.01)

(52) U.S. Cl.
CPC ..... *B65H 31/34* (2013.01); *B65H 31/26* (2013.01)

(58) Field of Classification Search
CPC ..... B65H 29/52; B65H 31/00; B65H 31/26; B65H 2405/11; B65H 31/34
USPC ..... 271/220
See application file for complete search history.

(56) References Cited

U.S. PATENT DOCUMENTS

| | | | | |
|---|---|---|---|---|
| 5,026,034 | A * | 6/1991 | Russel et al. | 271/220 |
| 5,154,411 | A | 10/1992 | Saito et al. | |
| 5,191,382 | A | 3/1993 | Okamura et al. | |
| 5,672,019 | A | 9/1997 | Hiramatsu et al. | |
| 5,725,206 | A | 3/1998 | Sugiyama | |
| 5,918,873 | A | 7/1999 | Saito et al. | |
| 6,106,114 | A | 8/2000 | Sugiyama | |
| 6,305,682 | B1 | 10/2001 | Saito et al. | |
| 6,412,774 | B1 * | 7/2002 | Saito et al. | 271/220 |
| 8,636,278 | B2 | 1/2014 | Emoto et al. | |
| 8,807,556 | B2 | 8/2014 | Sugiyama et al. | |
| 2006/0237900 | A1 * | 10/2006 | Sekiyama et al. | 271/220 |
| 2007/0063427 | A1 * | 3/2007 | Hong | 271/220 |

FOREIGN PATENT DOCUMENTS

JP 2006-273561 A 10/2006

* cited by examiner

*Primary Examiner* — David H Bollinger
(74) *Attorney, Agent, or Firm* — Fitzpatrick, Cella, Harper & Scinto

(57) ABSTRACT

A sheet stacking device that can appropriately stack, at a fixed position, sheets that are discharged to a discharge tray, and a printing apparatus are provided. A presser member holds down, at a pressing position, the sheets stacked on the discharge tray. The presser member is moved from the pressing position to a retraction position in a period after discharging of a sheet has been started and before discharging of a succeeding sheet is started.

10 Claims, 28 Drawing Sheets

SHEET STACKING DEVICE AND PRINTING APPARATUS

BACKGROUND OF THE INVENTION

1. Field of the Invention

The present invention relates to a sheet stacking device that stacks discharged sheets on a discharge tray, and a printing apparatus.

2. Description of the Related Art

When images have been printed on sheets (printing media), such as paper sheets, by a printing apparatus, generally, the sheets are discharged to and stacked on a discharge tray that is included in a post-processing device. In Japanese Patent Laid-Open No. 2006-273561, the arrangement wherein presser members used to hold down the sheets that are discharged on a discharge tray is described in order to obtain registration of the sheets discharged on the discharge tray. The presser members pivot downward to move to a pressing position to hold down the sheets on the discharge tray, or pivot upward to move to a retraction position apart from the discharge tray, and is to be turned up or down in synchronization with the discharging operation for discharging the sheet to the discharge tray. That is, when the presser members are located at the pressing position to hold down the sheets stacked on the discharge tray, the presser members are moved to the retraction position before the next sheet (the succeeding sheet) is discharged to the discharge tray, and are moved to the pressing position after the succeeding sheet is discharged to the discharge tray.

According to the printing apparatus described in Japanese Patent Laid-Open No. 2006-273561, since the presser members are moved to the retraction position before the succeeding sheet is discharged, and are moved to the pressing position after the succeeding sheet has been discharged, there is a possibility that the positions of the stacked sheets might be deviated when the succeeding sheet is discharged. In other words, when the succeeding sheet is discharged, the stacked sheets are not held down by the presser members, and therefore, the portion of the succeeding sheet, particularly, the leading edge of the succeeding sheet, might slide across the surface of the topmost sheet on the stack, and cause deviation of the stacked sheet. Furthermore, when the presser members pivot upward to move from the pressing position to the retraction position, the stacked sheet may be caught and flipped up. As a result, there is a possibility that the positions of the sheets discharged on the discharge tray might be deviated.

SUMMARY OF THE INVENTION

The present invention provides a sheet stacking device that can appropriately stack sheets on a discharge tray at a fixed position, and a printing apparatus.

In the aspect of the present invention, there is provided a sheet stacking device comprising:

- a discharge tray for receiving sheets that are discharged; and
- a presser member that holds down the sheets stacked on the discharge tray,
- wherein the presser member is retracted to a retraction position at a timing in a period from a start of discharging of a preceding sheet until a start of discharging of a succeeding sheet that follows the preceding sheet.

According to the present invention, since the presser member continues holding down the sheets stacked on the discharge tray even after the discharge of the preceding sheet has been started, the adverse effect of the preceding sheet on the alignment of the stacked sheets can be suppressed, and the sheets discharged to the discharge tray can be appropriately stacked in the fixed position.

Further features of the present invention will become apparent from the following description of exemplary embodiments (with reference to the attached drawings).

DESCRIPTION OF THE EMBODIMENTS

The embodiments of the present invention will now be described based on drawings.

First Embodiment

A sheet stacking device according to this embodiment represents an example wherein the device is incorporated into an ink jet printing apparatus and employed as a post-processing device that stacks, on a discharge tray, the sheets where an image has been printed.

(Arrangement of Ink Jet Printing Apparatus)

Figure 1:
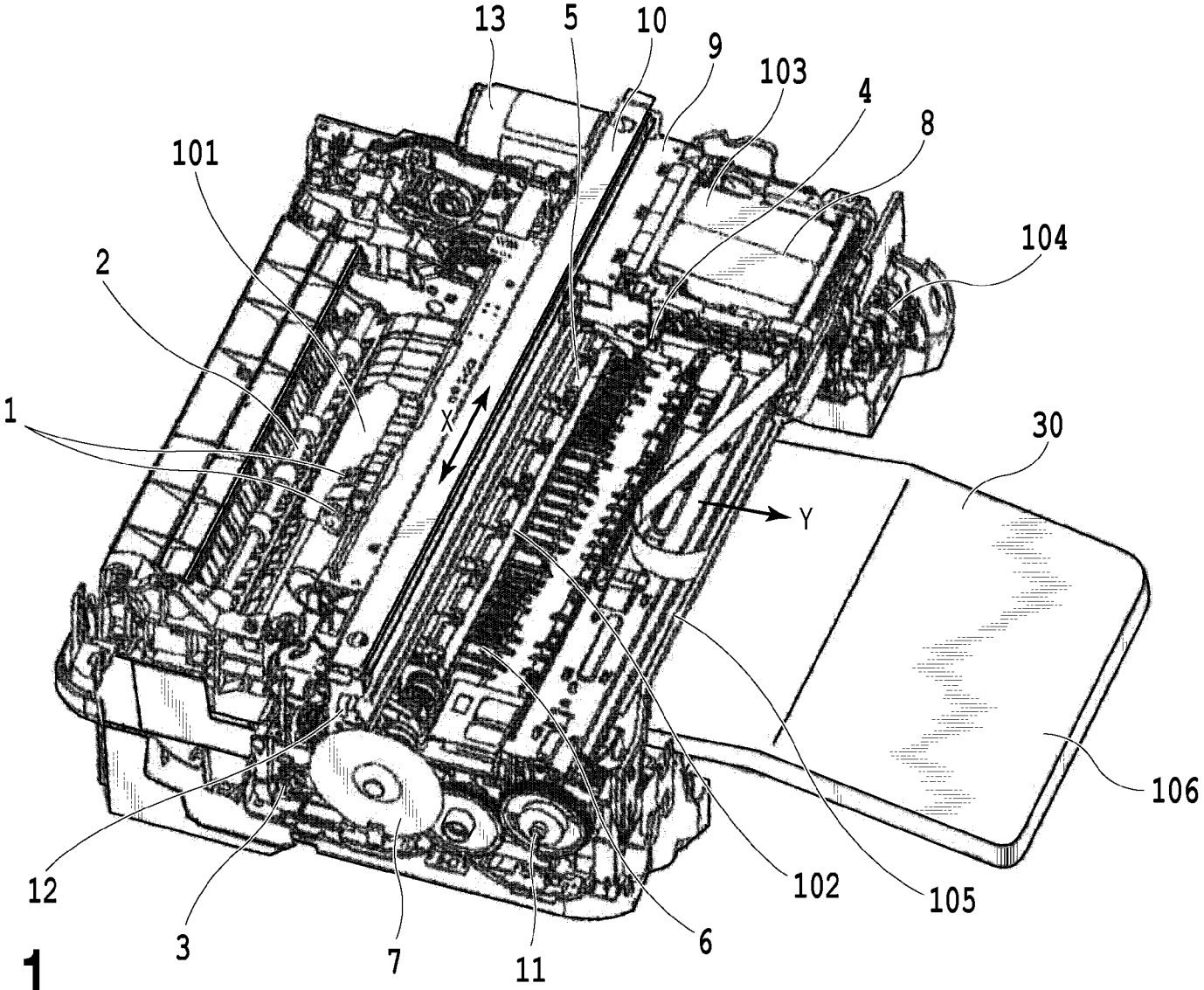
FIG. 1 is a perspective view of a printing apparatus according to a first embodiment of the present invention.

FIG. 1 is a perspective view of the essential part of a serial-scan-type ink jet printing apparatus, which includes a feeding unit 101, a conveying unit 102, a printing mechanism 103, a recovery mechanism 104, a discharging unit 105 and a sheet holding unit 106. The feeding unit 101 feeds a sheet (a printing medium), such as a sheet of paper, into the main body of the printing apparatus, and the conveying unit 102 conveys the sheet through the inside of the printing apparatus. The printing mechanism 103 prints an image on the sheet by ejecting ink from a print head 8 based on image data, and the recovery mechanism 104 performs a recovery process to maintain the ink ejection performance of the print head 8. The discharging unit 105 discharges to the sheet holding unit 106 the sheet on which the image has been printed.

The sheets loaded on the feeding unit 101 are separated by sheet feeding rollers 1, driven by a feeding motor, and a separation slope 2, and are fed one by one to the conveying unit 102. The sheet fed to the conveying unit 102 is conveyed to a platen 6 by a conveying roller 4, driven by a conveying motor 3, and pinch rollers 5. A roller, for which the surface of a metal shaft is coated with ceramic particles, is employed as the conveying roller 4. A code wheel 7 is adhered to an LF pulley (not shown) directly connected to the conveying roller 4, and based on a single (encoder signal) output by an encoder (not shown) located opposite the code wheel 7, the distance at which a sheet is to be conveyed is controlled.

A carriage 9 of the printing mechanism. 103 is guided so as to freely move along a guide rail 10, and the print head 8 is mounted on the carriage 9. The carriage 9 is reciprocated by receiving the drive force of a carriage motor 13 through a carriage belt 12, in a direction (the direction indicated by an arrow X; the main scan direction) intersecting with (in this embodiment, orthogonal to) the direction in which the sheet is to be conveyed (the direction indicated by an arrow Y; the sub-scan direction). In synchronization with the movement of the carriage 9 in the main scan direction, the print head 8 ejects ink, based on image data, to the sheet conveyed to the platen 6, so that an image is printed on the sheet. This printing operation and the operation for conveying the sheet at a predetermined distance are repeated, and printing of images is sequentially performed on the sheet.

The sheets on which the image has been printed are discharged, in order, to a discharge tray (delivery tray) 30 of the holding unit 106 by a discharging roller 11, driven synchronously with the conveying roller 3, and spurs 14 that are pressed by the discharging roller 11. As will be described later, in a case wherein the sheets where the image is printed are to be sorted and stacked on the discharge tray 30, the discharge tray 30 is moved together with presser members 31 in the direction intersecting with the direction in which the sheet is to be conveyed (in this embodiment, in the direction in parallel to the main scan direction in which the carriage 9 is to be moved). Hereinafter, this movement of the discharge tray 30 is also called "shift".

(Structure of Holding Unit 106)

Figure 2:
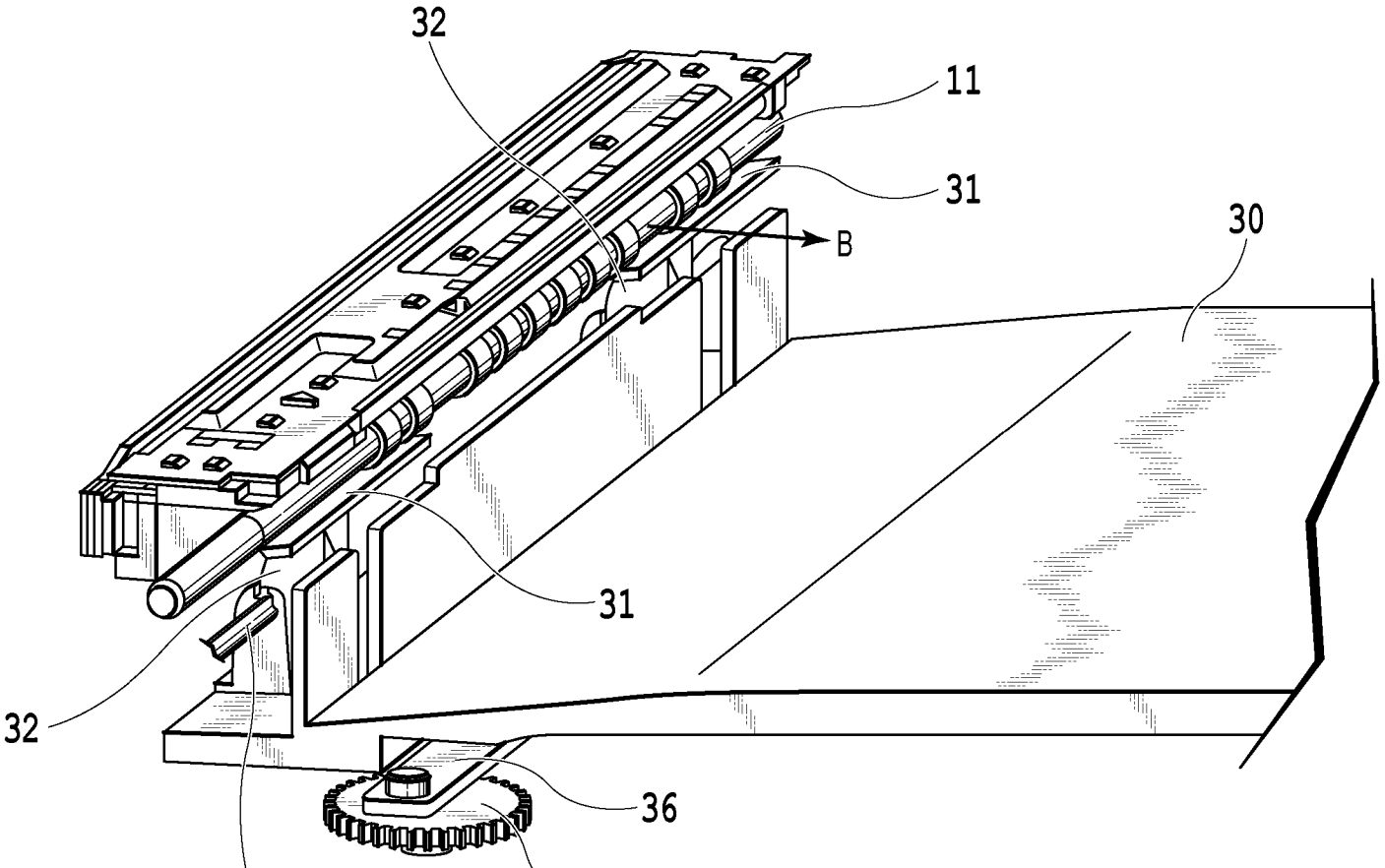
FIG. 2 is a perspective view of the essential part when presser members included in a holder unit in FIG. 1 are in a standby state.
Figure 3:
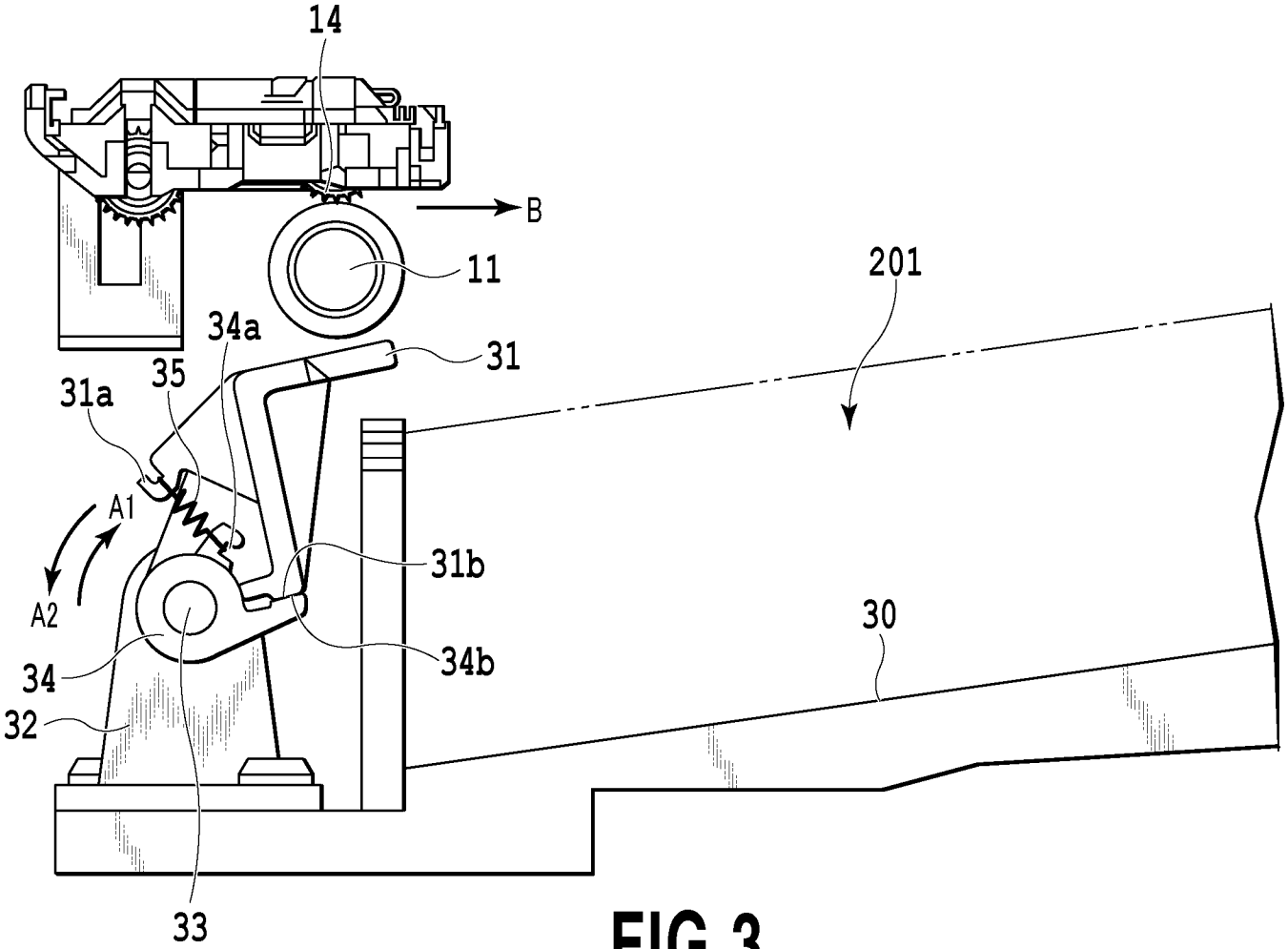
FIG. 3 is a cross-sectional view of the essential part when the presser members in FIG. 2 are in the standby state.

FIGS. 2 and 3 are explanatory diagrams for the structure of the essential part of the holding unit 106.

The sheet is discharged from the discharging unit 105 in a predetermined direction (a discharging direction indicated by an arrow B), so that the sheet is stacked on the discharge tray 30. The holding unit 106 includes the presser members 31 that hold, from above, the sheets stacked on the discharge tray 30. As will be described later, when the presser members 31 are pivoted, the sheet is held down between the discharge tray 30 and the presser members 31. As shown in FIGS. 2 and 3, when the presser members 31 are in the standby state before the printing operation is started, the presser members 31 are retracted at a standby position located outside a stacking area 201 of the discharge tray 30 and also outside a sheet discharge path, along which the sheet is conveyed to be stacked in the stacking area 201.

In the discharge unit 105, a rotary shaft 33 is supported by a holder 32 fixed to the discharge tray 30, and is rotatable in directions indicated by arrows A1 and A2 through a warm gear (not shown) by a rotation motor (also not shown). Stoppers 34 are fixed to the rotary shaft 33 so as to be rotated together. The presser members 31 are rotatably attached to the rotary shaft 33, and are urged in the direction indicated by the arrow A2 in FIG. 3 by tension springs 35 that are extended between spring hooks 31*a* of the presser members 31 and spring hooks 34*a* of the stoppers 34. When abutment portions 31*b* of the presser members 31 abut upon rotation regulators 34*b* of the stoppers 34, the rotation of the presser members 31 in the direction indicated by the arrow A2 is controlled, and therefore, the presser members 31 are halted at the standby position shown in FIGS. 2 and 3.

When the printing apparatus receives an instruction for the printing operation, the printing apparatus determines whether a sorting mode, i.e., a mode for sorting the printed sheets for each copy when being stacked on the discharge tray 30, should be performed. When the sorting mode is not required, the presser members 31 are maintained at the standby position shown in FIGS. 2 and 3, and the discharge tray 30 will not be shifted.

(Sheet Sorting Operation)

Figure 4:
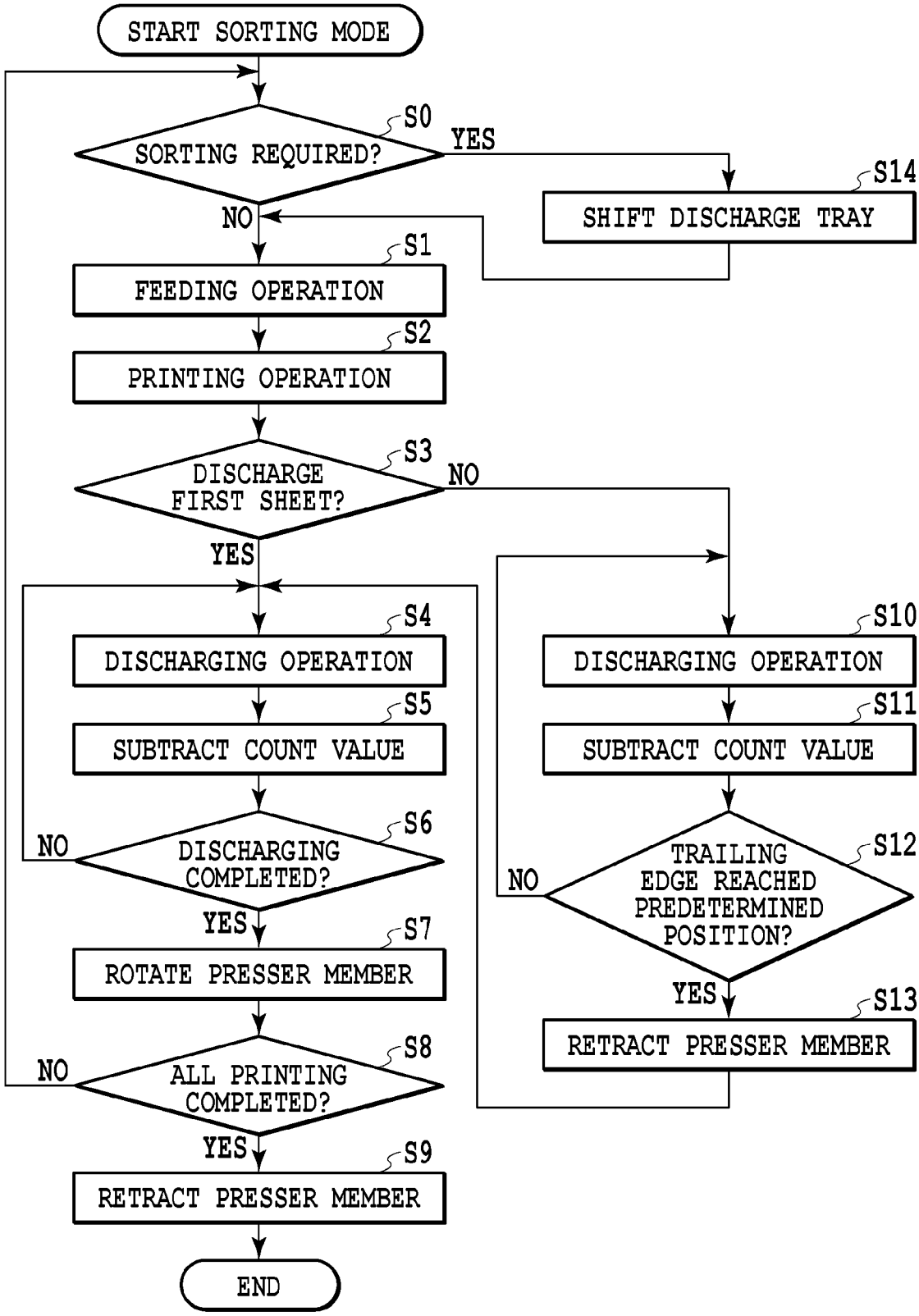
FIG. 4 is a flowchart for explaining a sorting mode for the printing apparatus in FIG. 1.

In a case wherein the sorting mode is employed, the sorting operation is performed in accordance with the flowchart in FIG. 4.

When the sorting mode is initiated, first, at step S0, when the sheet for which the printing is completed is to be discharged to the discharge tray 30, a check is performed to determine whether sorting control is required for the sheet with respect to the topmost sheet on the stack on the discharge tray 30. That is, when the (N+1)th sheet is to be discharged to the discharge tray 30 in a discharging direction indicated by the arrow B in FIG. 3, a check is performed to determine whether sorting should be performed for the (N+1)th sheet with respect to the N-th sheet on the stack on the display tray 30. When such sorting control is not required, the sheet feeding operation (step S1) and the printing operation (step S2) are performed. The distance at which the sheet is to be conveyed at this time is managed based on an encoder signal output by the encoder located opposite the code wheel 7.

Before the printing operation is started, a count value C of the encoder signal that corresponds to a distance L has been set in advance. The distance L represents a distance obtained by adding a predetermined margin to a distance extended from the location of a sheet edge detection sensor, which detects the trailing edge of the sheet, to a discharging roller nip at which the sheet is held by the discharging roller 11 and the spurs 14. In a case wherein the sheet edge detection sensor detects the trailing edge of the sheet, the number of encoder signals that corresponds to the distance at which the sheet is conveyed in a period from the detection of the trailing edge by the sheet end detection sensor until the start of the discharging operation (the delivering operation) is counted, and the obtained count value C1 is subtracted from the count value C that corresponds to the distance L. Thereafter, the count value C is overwritten with the results of subtraction (C−C1). The count value (C−C1) obtained by the subtraction corresponds to a length in the sheet conveying direction.

After the printing operation (step S2) for the sheet has been performed, a check is performed to determine whether the printed sheet is the first sheet to be discharged to the discharge tray 30 (step S3). In a case wherein the sheet is the first one to be discharged, the discharging operation is initiated to discharge the sheet to the discharge tray 30 (step S4). The distance at which the sheet is to be delivered is also managed based on the encoder signal output by the encoder located opposite the code wheel 7.

At the succeeding step S5, a count value C2 that corresponds to the distance at which the sheet is to be delivered by the discharging operation at step S4 is subtracted from the count value (C−C1) employed before the discharging operation was started at step S4. A check is performed to determine whether the subtraction result is "0", and based on the result, the completion of the discharging operation is determined (step S6). In a case wherein the discharging operation is not yet completed, the processes at steps S4 to S6 are repeated until the subtraction result at step S5 is "0".

Figure 5:
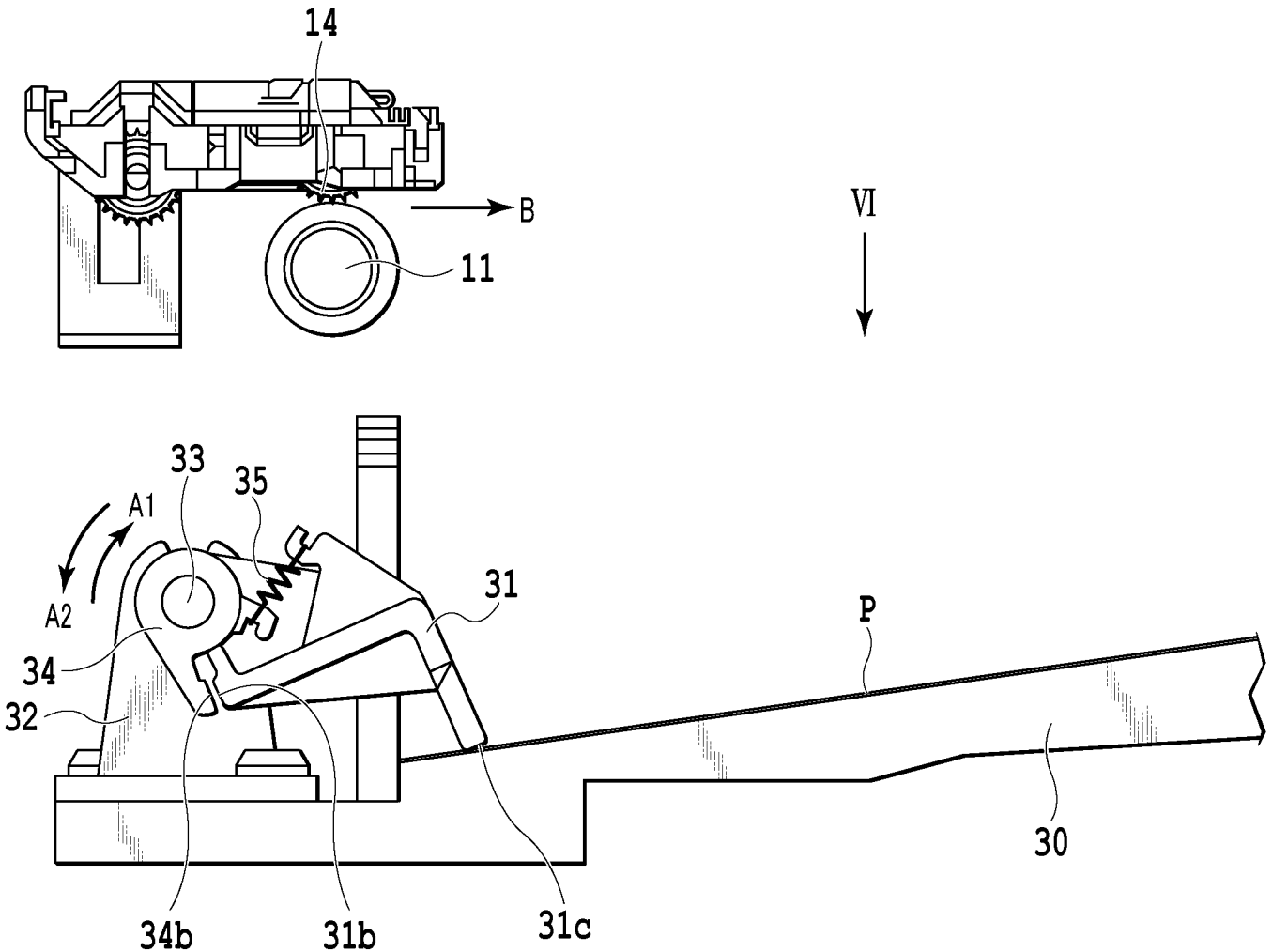
FIG. 5 is a cross-sectional view of the essential part when the presser members in FIG. 2 are in an operating state.

When the sheet discharging operation has been completed, program control advances from step S6 to step S7, and as shown in FIG. 5, the rotary shaft 33 is rotated, together with the stoppers 34, at 84° from the standby position in FIG. 3 in the direction indicated by the arrow A1. The presser members 31 are also pivoted by the tension springs 35 in the direction indicated by the arrow A1, and are halted, as shown in FIG. 5, at the location at which a sheet P that has been discharged to the discharge tray 30 is held down on the discharge tray 30 by operating portions 31C of the presser members 31. In the state shown in FIG. 5, a gap is present between the rotation regulators 34*b* of the stoppers 34 and the abutment portions 31*b* of the presser members 31.

Figure 6:
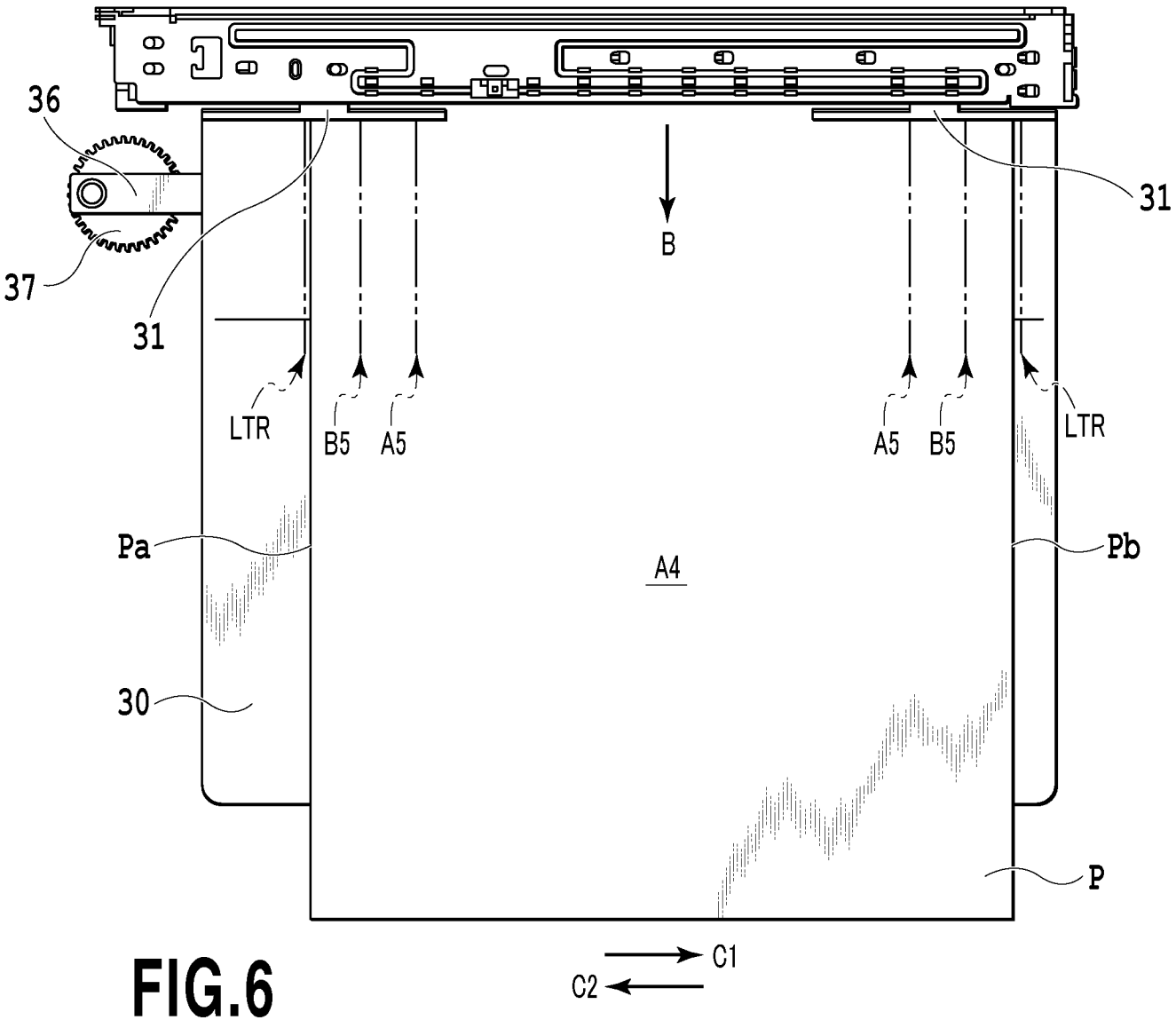
FIG. 6 is a view taken in the direction of an arrow VI in FIG. 5.

FIG. 6 is a plan view of the discharge tray 30 in the state in FIG. 5, taken from the side of the face where the sheet P is mounted. At this time, the discharge tray 30 is located, together with the presser members 31, at the position (a first stacking position) for the limit of movement in the direction indicated by an arrow C2 of the shifting directions indicated by arrows C1 and C2. Referring to FIG. 6, an A4 size sheet P that has been discharged lies on the discharge tray 30. The two presser members 31 provided respectively on the right and left sides in FIG. 6 press down the corresponding sides (the sides in a direction intersecting with the direction indicated by the arrow B) of the vicinity of the trailing edge of the sheet P that is positioned downstream in the direction in which the sheet P is discharged (the direction indicated by the arrow B). The presser members 31 are extended in a range from the trailing edge of the sheet P beyond left and right edges Pa and Pb of the sheet P, respectively. In FIG. 6, the positions of the two sheet edges for LTR (letter), B5 and A5 sizes are indicated by two-dot chain lines. For the LTR, B5 or A5 size sheet, the left and right presser members 31 can also press the vicinity of the trailing edge that includes the two edges Pa and Pb to hold down the sheet on the discharge tray 30.

After the sheet P has been pressed down toward the discharge tray 30 by the presser members 31 in this manner, at the following step S8, a check is performed to determine whether all of the information that should be printed on the sheet has been printed by the printing operation of the printing apparatus. In a case wherein all of the information has been printed on the sheet, program control moves to step S9. At step S9, the rotary shaft 33 is rotated, together with the stoppers 34, at 84° from the position in FIG. 5 in the direction indicated by the arrow A2, so that the presser members 31 are returned to the standby state in FIG. 3, and thereafter, the processing in FIG. 4 is terminated. In a case wherein all of the information is not yet printed on the sheet, program control returns to step S0, and when the next (N+1)th sheet is to be discharged to the discharge tray 30, a check is performed to determine whether sorting for the sheet with respect to the N-th sheet should be performed.

Figure 7:
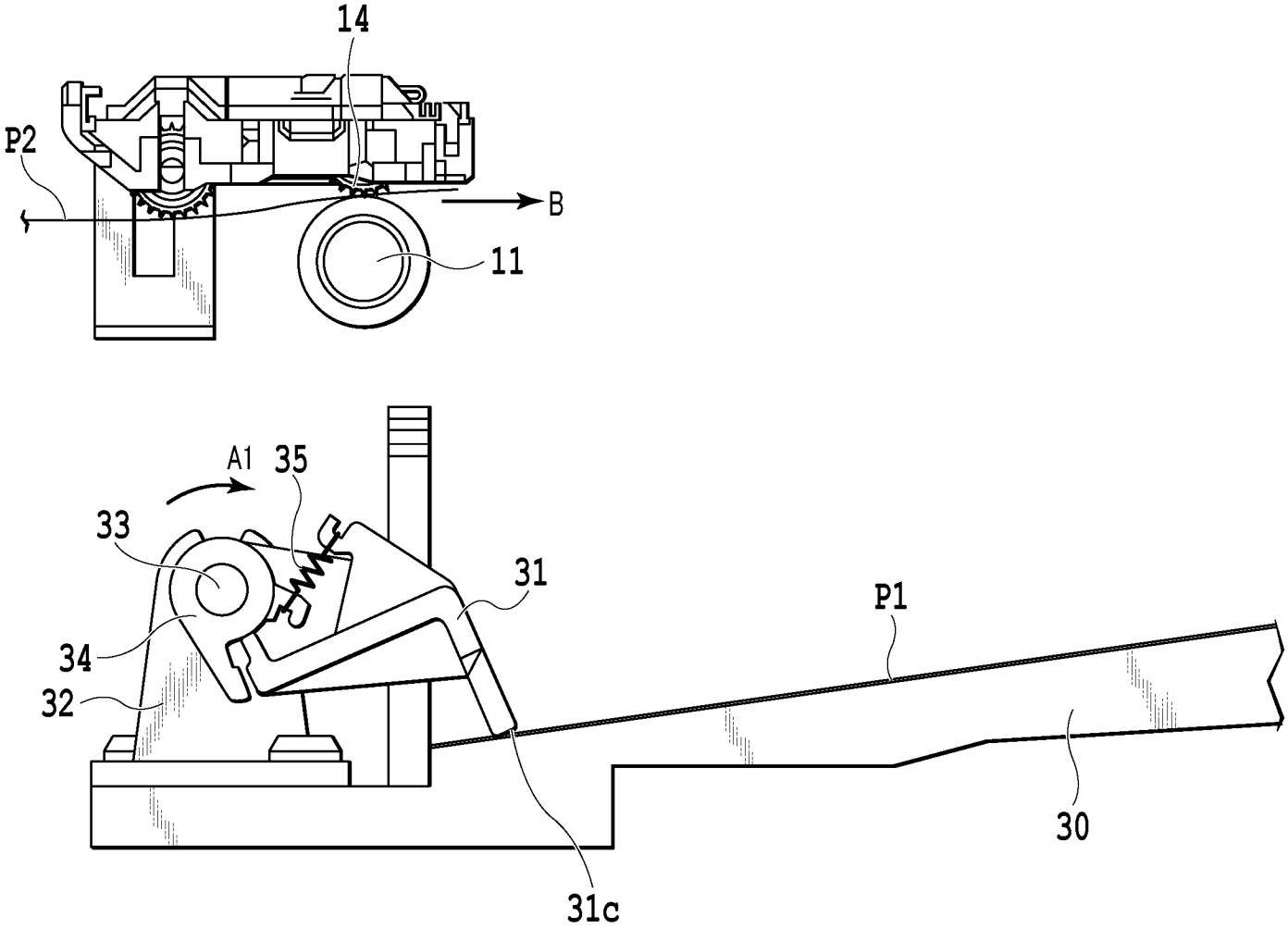
FIG. 7 is a cross-sectional view of the essential part at a stage during discharging of a second sheet.

Specifically, in case of N=1, i.e., in a case wherein image printing is to be performed on the second sheet P2, at step S0, a check is performed to determine whether the second sheet P2 should be accumulated by sorting control for the sheet P2 relative to the first sheet P1 that was previously printed. In a case wherein the sorting control is not required for the second sheet P2, the presser members 31 are maintained in position to hold down the sheet P1, as shown in FIG. 7, and the discharge tray 30 stays at the first stacking position in FIG. 6. Thereafter, in the same manner as performed for the sheet P1, the feeding operation (step S1) and the printing operation (step S2) for the sheet P2 are performed. When discharging of the sheet P2 is begun by the discharging roller 11 and the spurs 14, the sheet P1 is pressed down by the presser members 31, as shown in FIG. 7.

Figure 8:
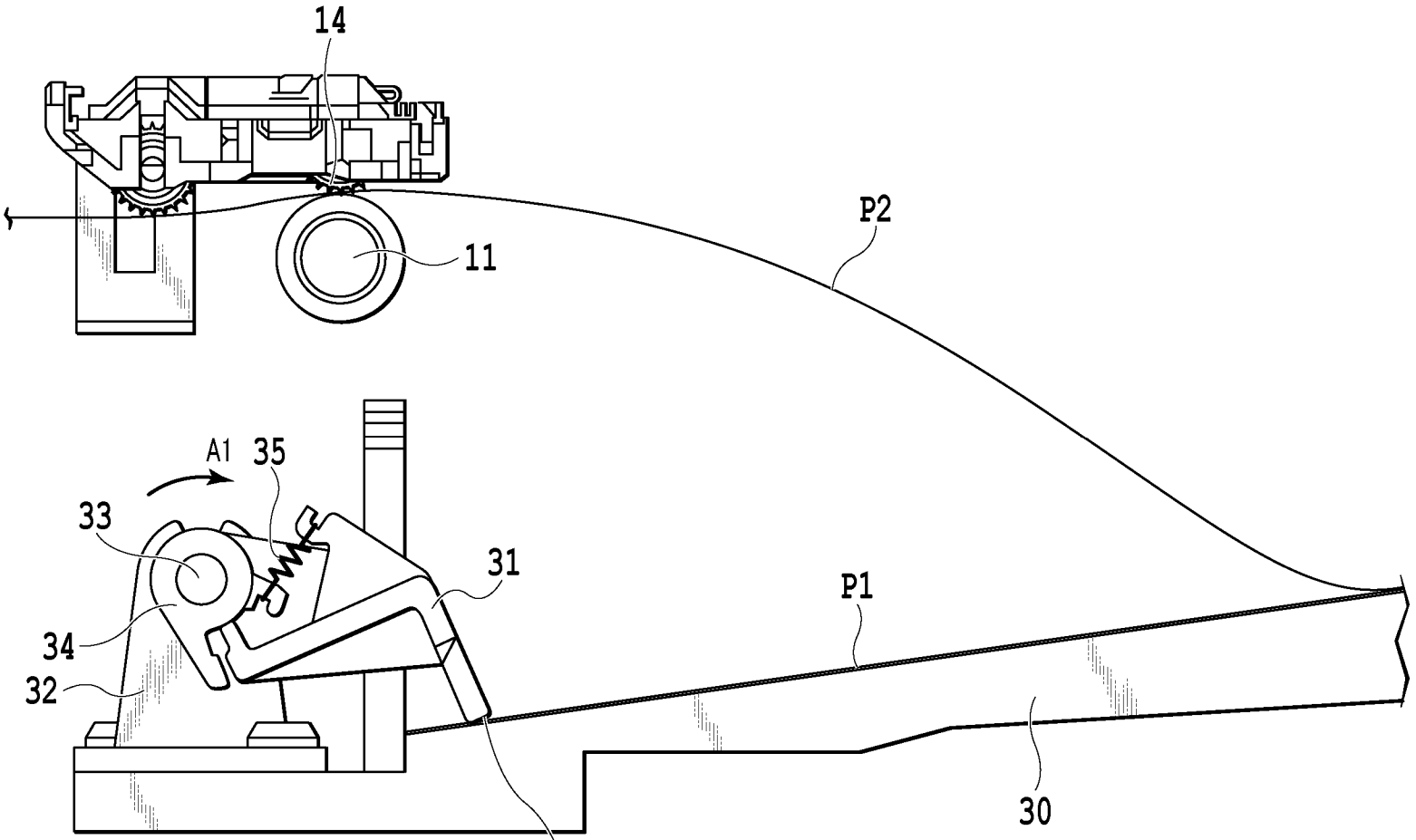
FIG. 8 is a cross-sectional view of the essential part at another stage during discharging of the second sheet.

At the succeeding step S3, since the current sheet P2 is the second sheet, it is ascertained that this is not the first sheet discharge, and program control moves to step S3 to step S10 and step S11. At step S10 and step S11, the same processes as those previously described at step S4 and S5 are performed. When the discharging operation of the sheet P2 is continued, as shown in FIG. 8, the leading edge of the sheet P2 contacts the sheet P1. When the discharging operation for the sheet P2 is further continued, the presser members 31 are still at the position for pressing down the sheet P1, as shown in FIGS. 7 and 8.

At step S12, based on a count value subtracted at step S11, i.e., a count value that corresponds to the length obtained by subtracting, from a length in the sheet conveying direction, the distance at which the sheet is delivered by the discharging operation, a check is performed to determine whether the trailing edge of the sheet P2 has reached a predetermined position. The predetermined position is set by being shifted by 5 mm upstream from the clamp portion (nip) of the discharging roller 11 and the spurs 14 in the discharge direction (the direction indicated by the arrow B). At step S12, a check is performed to determine whether the count value subtracted at step S11 is equal to the count value that corresponds to the conveying length of 5 mm. In a case wherein the count value subtracted at step 11 is not equal to the count value that corresponds to the conveying length of 5 mm, the processes at step S10 to S12 are repeated until the count value subtracted at step S11 is equal to the count value that corresponds to the conveying length of 5 mm.

Figure 10:
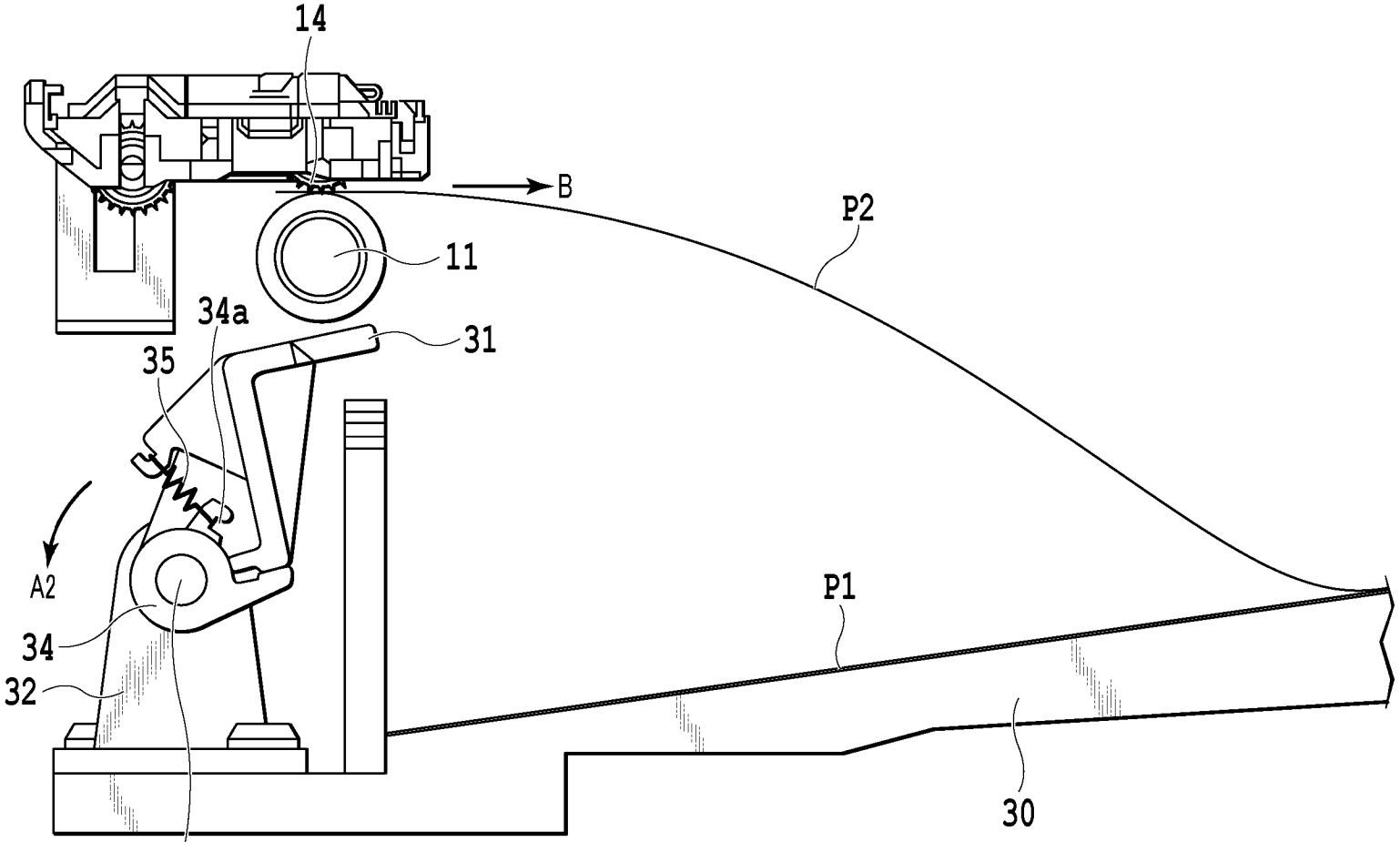
FIG. 10 is a cross-sectional view of the essential part at yet another stage during discharging of the second sheet.

In a case wherein the count value subtracted at step S11 is equal to the count value that corresponds to the conveying length of 5 mm, program control moves to the succeeding step S13. At step S13, the rotary shaft 33 is rotated, together with the stoppers 34, at 84° in the direction indicated by the arrow A2, as shown in FIG. 10, and the presser members 31 are returned to the standby state shown in FIG. 3.

Figure 9:
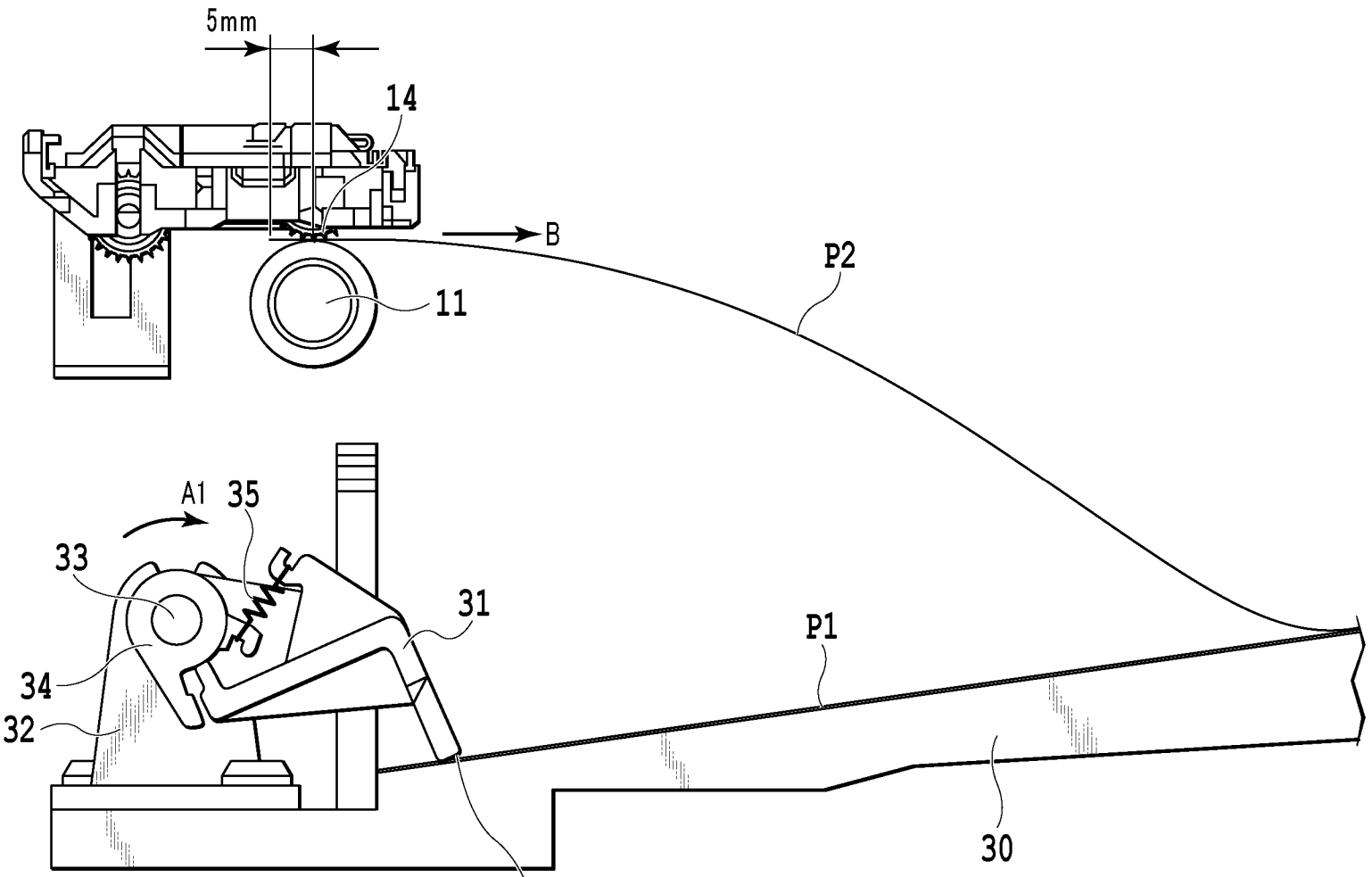
FIG. 9 is a cross-sectional view of the essential part at a further stage during discharging of the second sheet.

Therefore, during a period from the start of the discharging of the sheet P2 until establishment of the discharged state shown in FIG. 9, the presser members 31 are maintained at the pressing position to hold down the sheet P1 on the discharge tray 30, and the occurrence of the position deviation of the sheet P1 by contacting the sheet P2 is suppressed. The presser members 31 need only to move from the pressing position to the retraction position within a period after at least one part of the sheet P2 contacted the sheet P2 and before discharging of the sheet P2 is completed (laying of the sheet P2 on the sheet P1 is completed).

Figure 11:
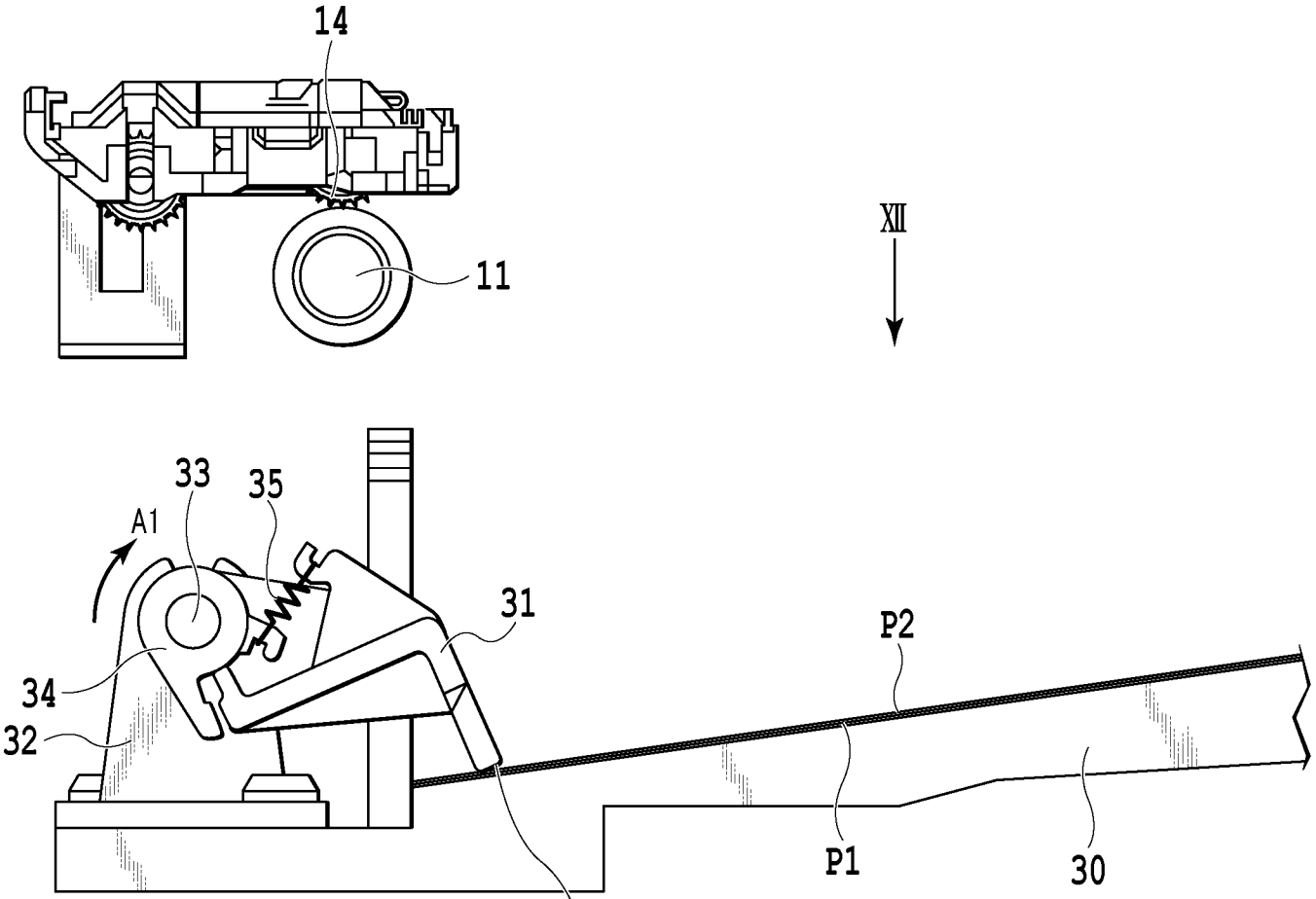
FIG. 11 is a cross-sectional view of the essential part for the presser members in the operating state when the second sheet has been discharged.
Figure 12:
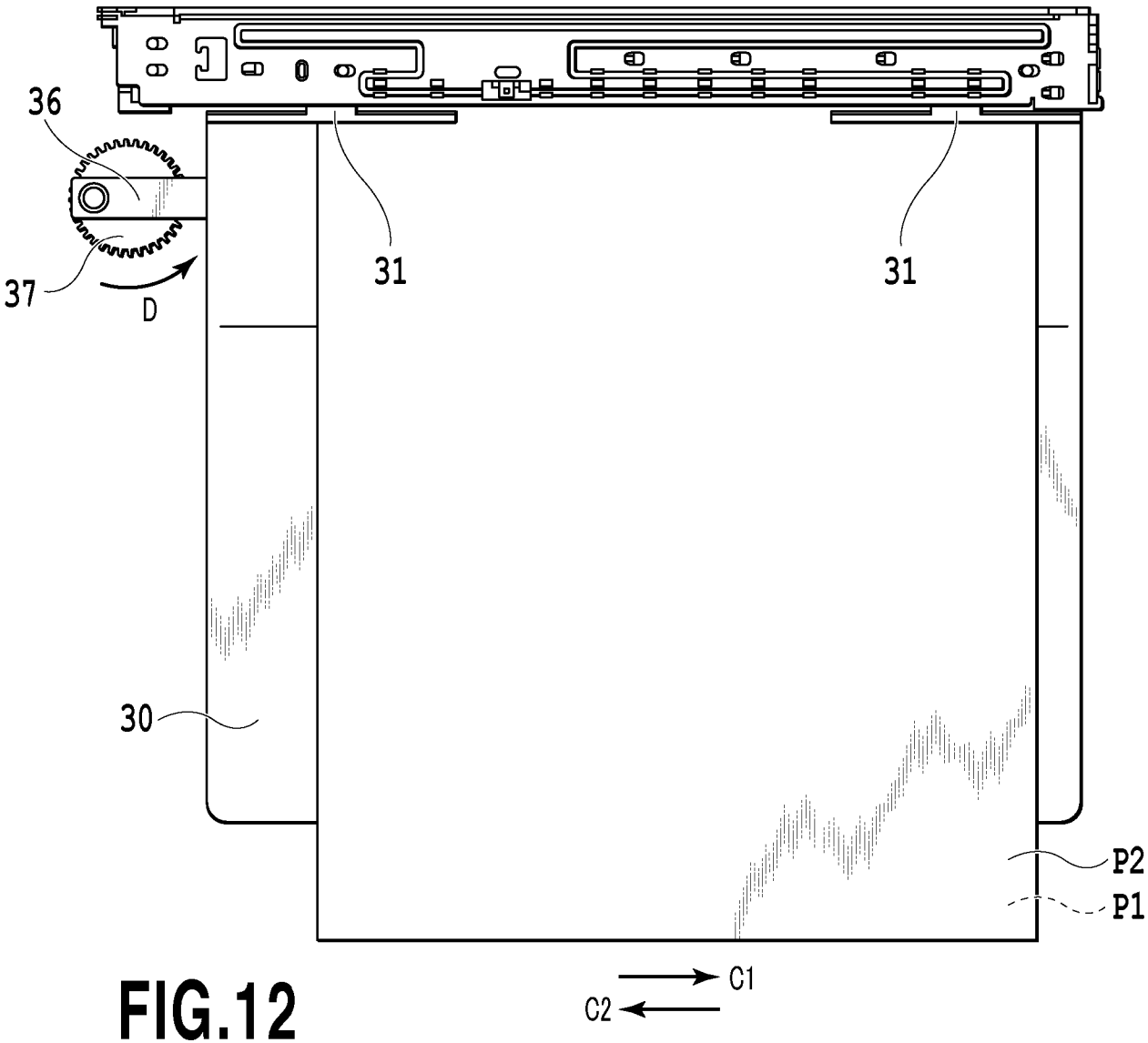
FIG. 12 is a view taken in the direction of an arrow XII in FIG. 12.

Thereafter, program control is shifted to the next step S4, and as previously described, the discharging operation (step S4) and the subtraction of the count value (step S5) are performed, and when the discharging operation is completed, the presser members 31 are pivoted in the direction indicated by the arrow A1 (steps S6 and S7). As a result, as shown in FIG. 11, the sheet P1 and the sheet P2 that have been already discharged are held between the operating portions 31C of the presser member 31 and the discharge tray 30. As shown in FIG. 12, the sheets P1 and P2 are laid one on top of another on the discharge tray 30 that is located together with the presser members 31 at the first stacking position. When, at the succeeding step S8, all of the information is not yet printed on the sheet, program control returns to the previous step S0, and when the third sheet P3 is to be discharged to the discharge tray 30, a check is performed to determine whether sorting for the third sheet P3 with respect to the second sheet P2 should be performed.

Figure 13:
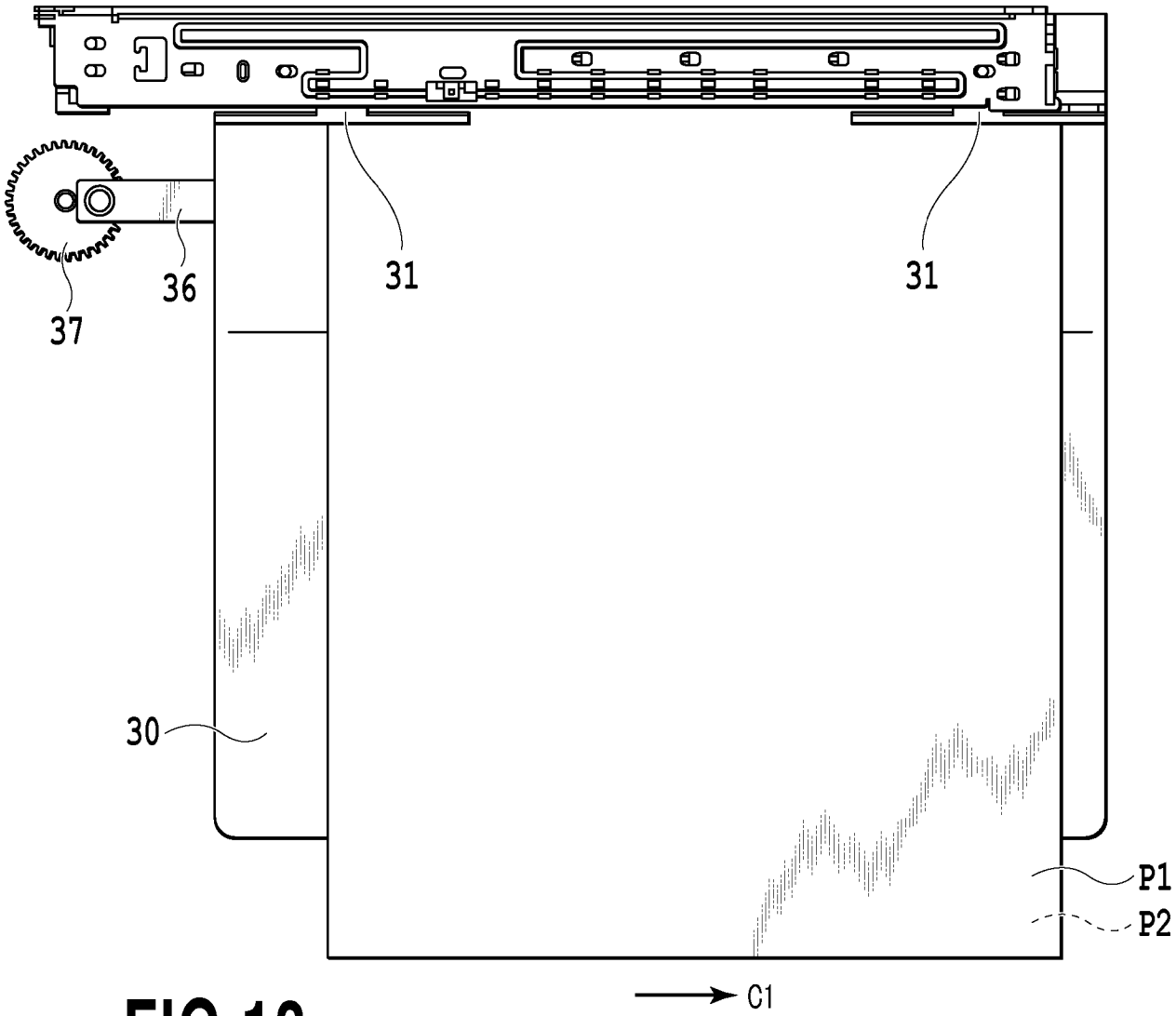
FIG. 13 is an explanatory diagram for the discharge tray shifting operation performed after the second sheet has been discharged.

In a case wherein sorting should be performed for the third sheet P3 with respect to the second sheet P2, program control is shifted to step S14. At step S14, as shown in FIG. 13, the discharge tray 30 is moved, together with the presser members 31, in the direction indicated by the arrow C1 to be shifted from the first stacking position to a second stacking position. The discharge tray 30 is guided by a guide member (not shown) so as to be movable in the directions indicated by the arrows C1 and C2. The discharge tray 30 is shifted from the first stacking position in FIG. 12 to the second stacking position in FIG. 13 by performing the following operation.

In the state shown in FIG. 12, a link gear 37 is rotated by a motor (not shown) at 180° in a direction indicated by an arrow D. As a result, a link 36 that is coupled, at a portion near one end, with the link gear 37 is moved. The other end portion of the link 36 is movably connected to the discharge tray 30, and in accordance with the movement of the link 36, the discharge tray 30 is moved at a distance of 20 mm in the direction indicated by the arrow C1, and reaches the second stacking position in FIG. 13. Since the presser members 31 are attached, via the rotary shaft 33, to the holders 32 fixed to the discharge tray 30, the presser members 31 are also shifted, together with the discharge tray 30, to the second stacking position, while the presser members 31 continue pressing down the sheets P1 and P2 on the discharge tray 30. When the discharge tray 30 has been shifted to the second stacking position, together with the presser members 31 and the sheets P1 and P2, program control moves to the next step S1.

Figure 14:
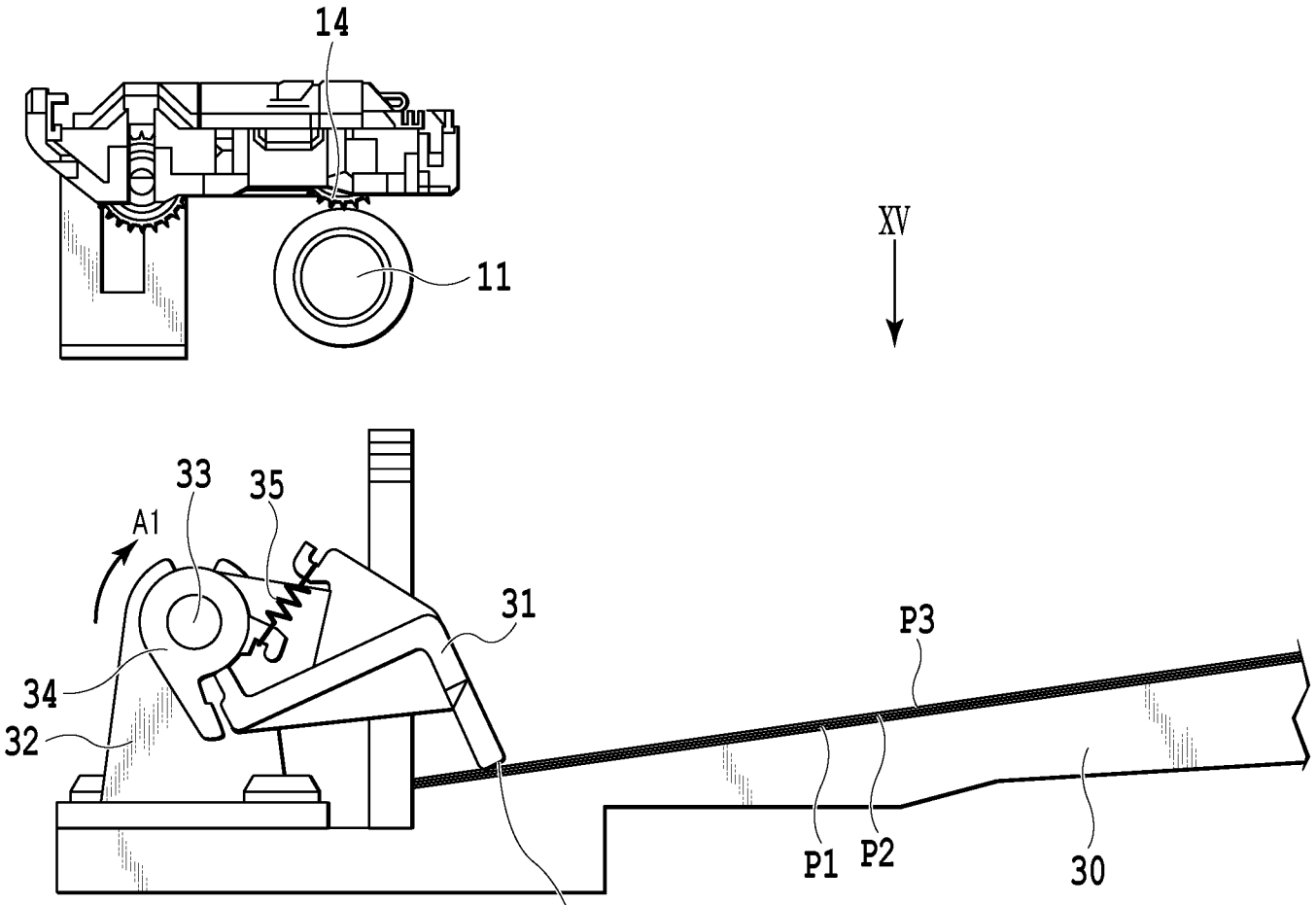
FIG. 14 is a cross-sectional view of the essential part for the presser members in the operating state after a third sheet has been discharged.

At step S1, the feeding operation for the third sheet P3 is performed, and thereafter, as well as the processing performed for the second sheet P2, the processes at steps S2, S3, S10, S11, S12, S13, S4, S5 and S6 are performed, and program control thereafter moves to step S6. When the discharging operation for the sheet P3 is completed, program control moves from step S6 to step S7, and in the same manner as for the above described case, the presser members 31 are pivoted in the direction indicated by the arrow A1. As a result, as shown in FIGS. 14 and 15, the sheet P1, the sheet P2 and the sheet P3 that have been already discharged are sandwiched between the operating portions 31C of the presser members 31 and the discharge tray 30.

Figure 15:
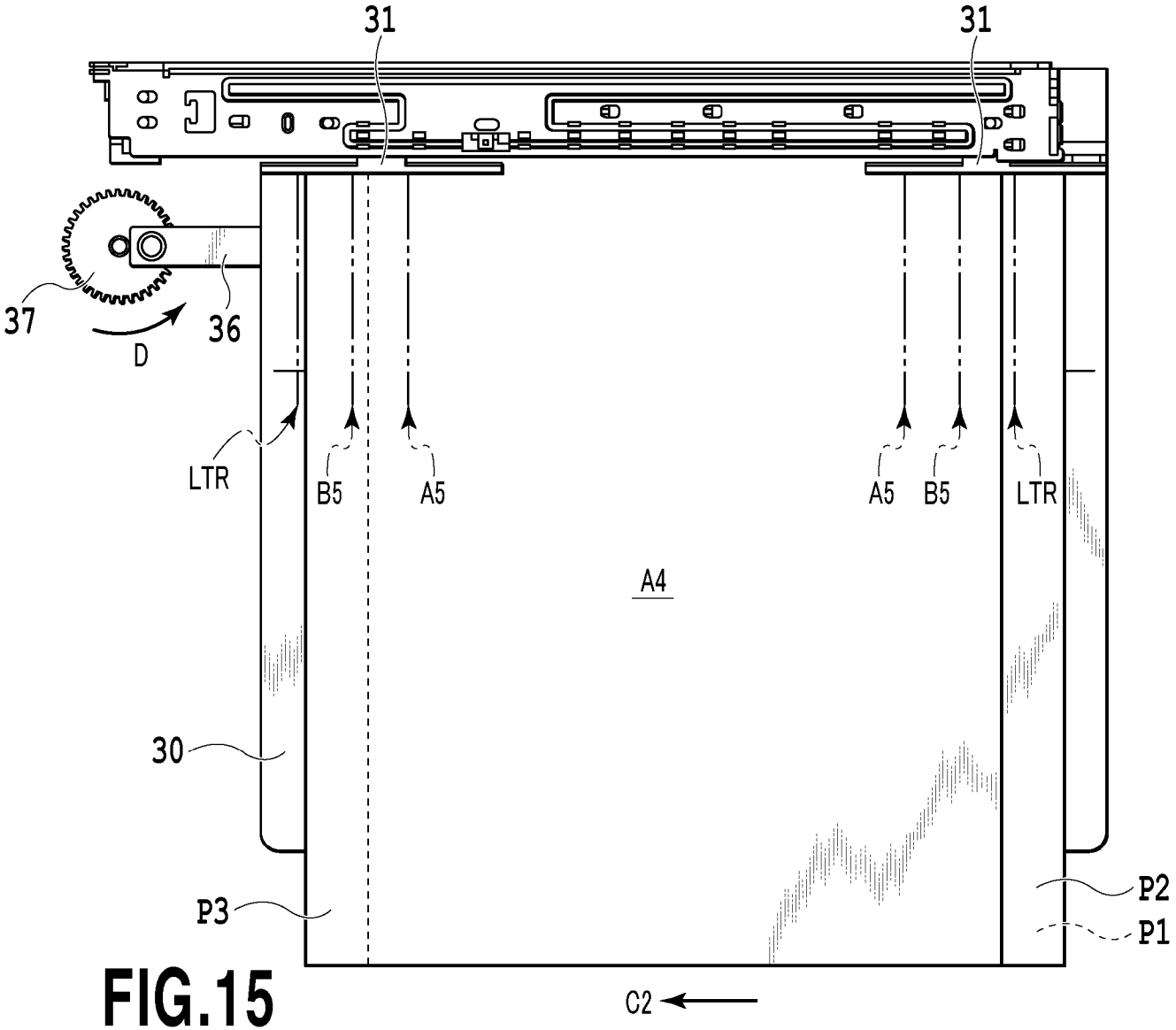
FIG. 15 is a view taken in the direction of an arrow XV in FIG. 14.

At the second stacking position in FIG. 15, in the same manner as performed for the sheets P1 and P2 of A4 size, the two presser members 31 press, against the discharge tray 30, the vicinity, including the right and left ends, of the trailing edge of the A4 sheet P3. In FIG. 15, the positions of the left and right ends of the LTR (letter), B5 and A5 sheets, discharged on the discharge tray 30 at the second stacking position, are indicated by two-dot chain lines. The two presser members 31 can press, against the discharge tray 30, the vicinity of the trailing edge of the sheet, including the left and right ends, regardless of the sizes of the sheets. As for the sheet P2 that was discharged to the discharge tray 30 at the first stacking position, the trailing edge vicinity (the right side near the trailing edge), including the right end portion in FIG. 15, is exposed to the topmost surface of the stack. Therefore, the right side of the sheet P2 near the trailing edge is directly operated by the right presser member 31 in FIG. 15, and is therefore pressed against the discharge tray 30. Furthermore, as previously described, the two sheet presser members 31 can press, against the discharge tray 30, the trailing edge vicinity of the A4, LTR, B5 or A5 sheet, including the left and right end portions, regardless of the location of the discharge tray 30, either the first stacking position or the second stacking position.

As described above, either at the first or the second stacking position, the two presser members 31 can press, against the discharge tray 30, the trailing edge vicinity, including the two end portions, of the last sheet of A4, LTR, B5 or A5 size that was discharged. In a case wherein discharging of the sheets has been completed at the one of the two stacking positions, and thereafter, the sheets including the last sheet are discharged at the other stacking position, either the left or right end portion of the last sheet that was discharged at the one of the stacking positions is exposed to the surface of the stack. Therefore, the trailing edge vicinity of the sheet exposed to the surface of the stack, including either the left or right end portion, is directly pressed down by either one of the presser members 31 on the corresponding side.

After the sheet is pressed down by the presser members 31 in this manner (step S7), program control moves to step S8, and in a case wherein all of the information is not yet printed on the sheets, program control returns to step S0. At step S0, when the fourth sheet P4 is to be discharged to the discharge tray 30, a check is performed to determine whether sorting for the sheet P4 with respect to the third sheet P3 is required.

In a case wherein the sorting for the sheet P4 with respect to the third sheet P3 should be performed, the link gear 37 is rotated at 180° from the position shown in FIG. 15 in the direction indicated by the arrow D. As a result, the discharge tray 30 is shifted via the link 36 at a distance of 20 mm in the direction indicated by the arrow C2, and is returned to the first stacking position shown in FIG. 6 and FIG. 12. Since the presser members 31 are attached via the rotary shaft 33 to the holders 32 of the discharge tray 30, the presser members 31 are shifted, together with the discharge tray 30, while being pressing the sheets against the discharge tray 30.

As described above, when the sorting operation is performed, the presser members 31 are moved together with the discharge tray 30, while being pressing the sheets against the discharge tray 30. Therefore, the presser members 31 do not rub against the image formation face of the sheet, and a deterioration of the image on the image formation face due to smearing does not occur. Furthermore, since the presser members 31 directly operate the topmost sheets at the two stacking positions, and hold down the portions of the sheets near the trailing edges, the sorting operation can be performed with preventing curling of the pertinent portions. As a result, creases or folds of the sheet caused when the curled portion at the trailing edge of the sheet contacts the main body of the printing apparatus can be prevented.

Further, when the leading edge of the succeeding sheet is passing the nip between the discharging roller 11 and the spurs 14, the presser members 31 directly operate the topmost sheet on the stacks at the two stacking positions, and hold down the curled portions of the sheet located near the discharging roller 11. As a result, the curled portion of the sheet placed on the discharge tray 30 and located near the discharging roller 11 is held down, so that the leading edge of the succeeding sheet will not contact the curled portion, and the occurrence that discharging of the succeeding sheet to the discharge tray 30 is not enabled can be prevented.

Second Embodiment

According to the first embodiment, the portion of the sheet that the presser members press to urge the sheet toward the discharge tray is the vicinity of the trailing edge of the sheet, including the left and right end portions. The left and right end portions of the sheet are not always included as portions to be pressed by the presser members. In the region where the sheet tends to be curled in the direction apart from the discharge tray due to the moisture of a printing material, such as ink, the presser members can press down arbitrary portions of the sheet to prevent the occurrence of such curling of the sheet.

Figure 16:
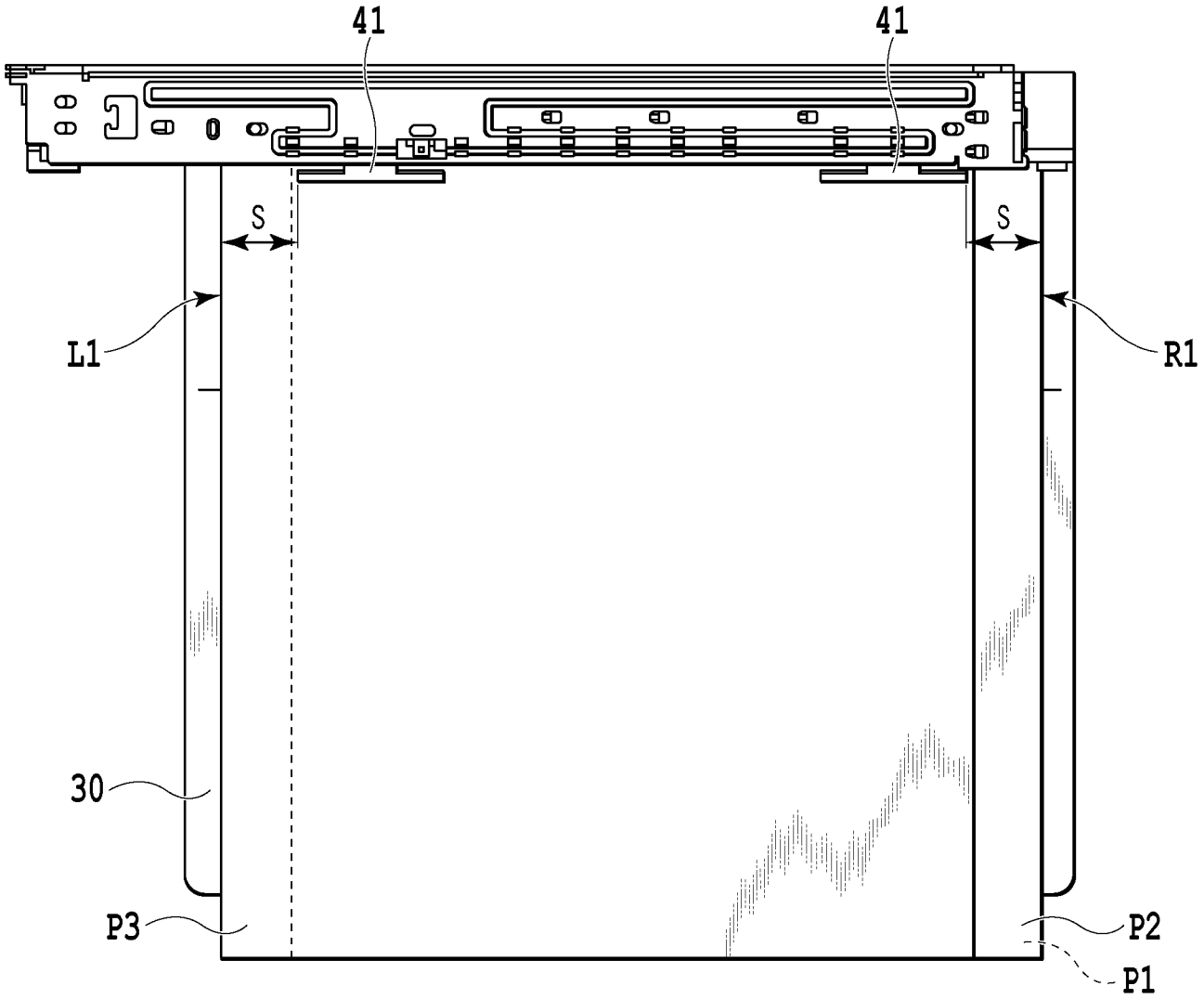
FIG. 16 is a plan view of the essential part according to a second embodiment of the present invention when presser members are in an operating state.

In this embodiment, an image (e.g., a solid image) is printed in the entire printing area of plain paper that serves as a sheet under the condition that curling of the sheet tends to occur most frequently, and based on the obtained result, the sheet pressing positions for presser members are determined. For example, in a case shown in FIG. 16, wherein sheets P2 and P3 are piled on a discharge tray 30, correlating of the pressing positions of presser members 41 with outermost edges L1 and R1 in the widthwise direction of the sheet is performed. The edge L1 is the left side edge of the sheet P3 shown in FIG. 16, while the edge R1 is the right side edge of the sheet P2 also shown in FIG. 16. The sheet pressing position of the presser member 41 provided on the left side in FIG. 16 is determined, so that a distance S between the edge L1 and the left end of the corresponding left presser member 41 falls within about 10% of the width of the sheet. Likewise, the sheet pressing position of the presser member 41 provided on the right side in FIG. 16 is determined, so that a distance S between the edge R1 and the right end of the corresponding right presser member 41 falls within about 10% of the width of the sheet. When the presser members 41 are arranged in this manner, the effects obtained in the above described embodiment are also provided for this embodiment.

Third Embodiment

Figure 17:
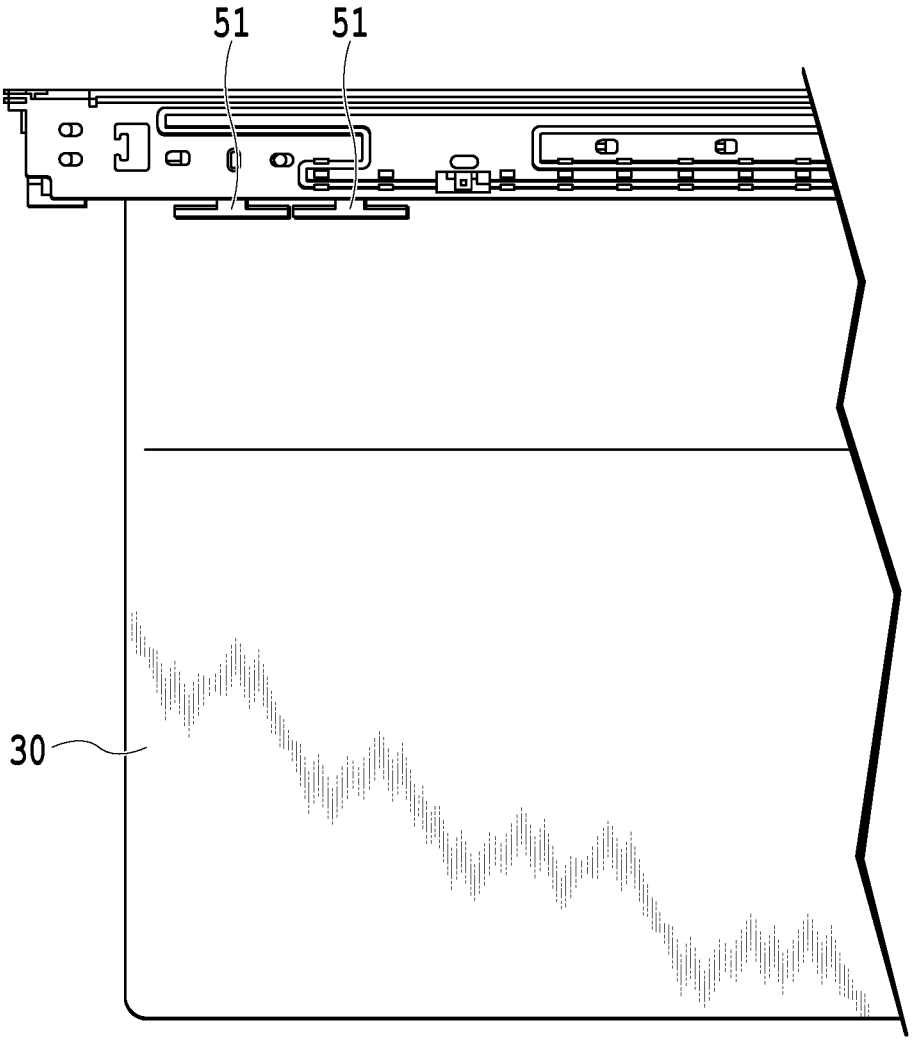
FIG. 17 is a plan view of the essential part according to a third embodiment of the present invention when presser members are in an operating state.

According to the first or second embodiment, the two presser members 31 or 41 are located, respectively, opposite the left and right ends of the sheet. However, the number of the presser members 31 or 41 arranged at a location opposite one end of the sheet is not limited to only one. In this embodiment, as shown in FIG. 17, a plurality of (two in this embodiment) presser members 51 are arranged at a position opposite one end of a sheet. With this arrangement, the effects obtained in the above described embodiments can also be provided.

Further, in the above described embodiments, no special treatment has been performed for the operating portions of the presser members, e.g., the operating portions 31C of the presser members 31 of the first embodiment. In a case wherein there is a possibility that ink on the image formation face of the sheet might be attached to the operating portions of the presser members, it is appropriate that the operating portions be coated with the same ceramic particles as those applied to the surface of the conveying roller 4. With this treatment, the contact area for the unit length where the operating portions of the presser members contact the image formation face can be reduced, and as well as in case of the spurs 14, attachment of ink from the image formation face to the operating portions can be suppressed. Furthermore, the numerical values explained in the above described embodiments are merely examples, and values employed are not limited to those values.

Fourth Embodiment

Figure 18:
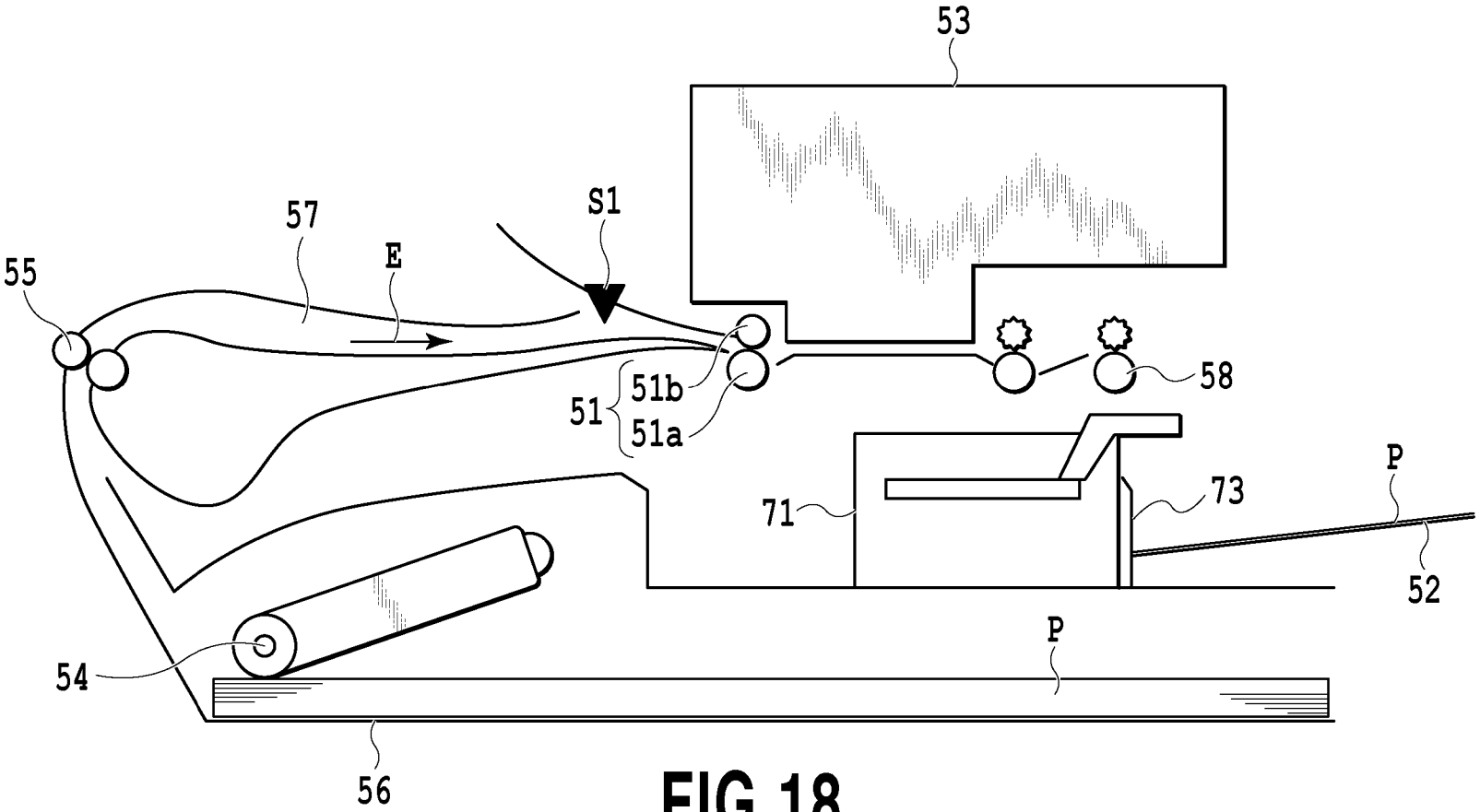
FIG. 18 is a schematic diagram illustrating the structure of a printing apparatus according to a fourth embodiment of the present invention.

FIG. 18 is a schematic diagram illustrating the structure of a printing apparatus according to a fourth embodiment of the present invention. The printing apparatus in this embodiment is an example when the present invention is applied for an ink jet printing apparatus. However, the printing apparatus of the present invention is not limited only to an ink jet printing type.

The printing apparatus of this embodiment includes, as shown in FIG. 18, a sheet supply cassette 56 where sheets (printing media) P are loaded and stored, a feeding roller 54 for feeding the sheet P and a conveying roller pair 55 for conveying the sheet P supplied by the feeding roller 54. The sheet P that has been supplied is conveyed along a conveying path 57 in a conveying direction indicated by an arrow E, and the leading edge and the trailing edge of the sheet P are detected by a detection sensor S1, which is located upstream from the conveying roller pair 51 in the conveying direction. The conveying roller pair 51 consists of a conveying roller 51*a*, serving as a drive roller, and a driven roller 51*b*, and a roller for which the surface of a metal shaft is coated with ceramic particles is employed as the conveying roller 51*a*. The sheet P that has passed the detection sensor S1 is conveyed by the conveying roller pair 51 at a predetermined distance, and reaches an image formation position, opposite an ink jet print head that is mounted on a carriage 53. For the sheet P at the image formation position, images are sequentially formed by repeating an operation for ejecting ink while moving the print head, together with the carriage 53, in a direction perpendicular to the plane of paper of FIG. 18 (the main scan direction), and an operation for conveying the sheet P at the predetermined distance. The sheet P on which the image has been formed is finally discharged to a discharge tray (delivery tray) 52 by a discharging roller pair 58. A pressing mechanism 71 that holds down the sheets P stacked on the discharge tray 52 is arranged below the discharging roller pair 58. The pressing mechanism 71 presses down the sheets P against the discharge tray 52 so as to hold the sheets P between the pressing mechanism 71 and the discharge tray 52.

A pressing position, a retraction position and a standby position described below are set for the pressing mechanism 71. The pressing position is a position at which, as shown in FIG. 22B, presser members 110 that will be described later hold down the sheet P on the discharge tray 52 to urge the sheet P toward the discharge tray 52. The retraction position is a position at which, as shown in FIG. 23C, the presser members 110 are retracted from the surface of the sheet P placed on the discharge tray 52. The standby position is defined as a position, other than the pressing position and the retraction position, at which the presser members 110 are located in a period other than a period for traveling between the pressing position and the retraction position. The presser members 110 are located at the retraction position at the start of printing. A direction in which the sheet P is to be discharged is defined as a +F direction, and the opposite direction is defined as a −F direction.

The pressing mechanism 71 includes the presser members 110 for pressing down the sheet P that has been discharged to the discharge tray 52, and rollers 111 provided for the portions of the presser members 110 that abut upon the sheet P. When the sheet P is discharged to the discharge tray 52 by the discharging roller pair 58, the sheet P is held down by the presser members 110 and is urged toward the discharge tray 52. The pressing mechanism 71 also includes latches 112, sliders 113 that move the presser members 110 and the latches 112, a guide member 114 that guides the presser members 110, the latches 112 and the sliders 113, and a link lever 115 that transmits a drive force. The presser members 110 can be moved between the pressing position, shown in FIG. 22B, to hold down the trailing edge of the first sheet (the preceding sheet) P1 that is discharged to the discharge tray 52, and the retraction position, shown in FIG. 23C, to be drawn back in the −F direction from the trailing edge of the preceding sheet P1.

Figure 19:
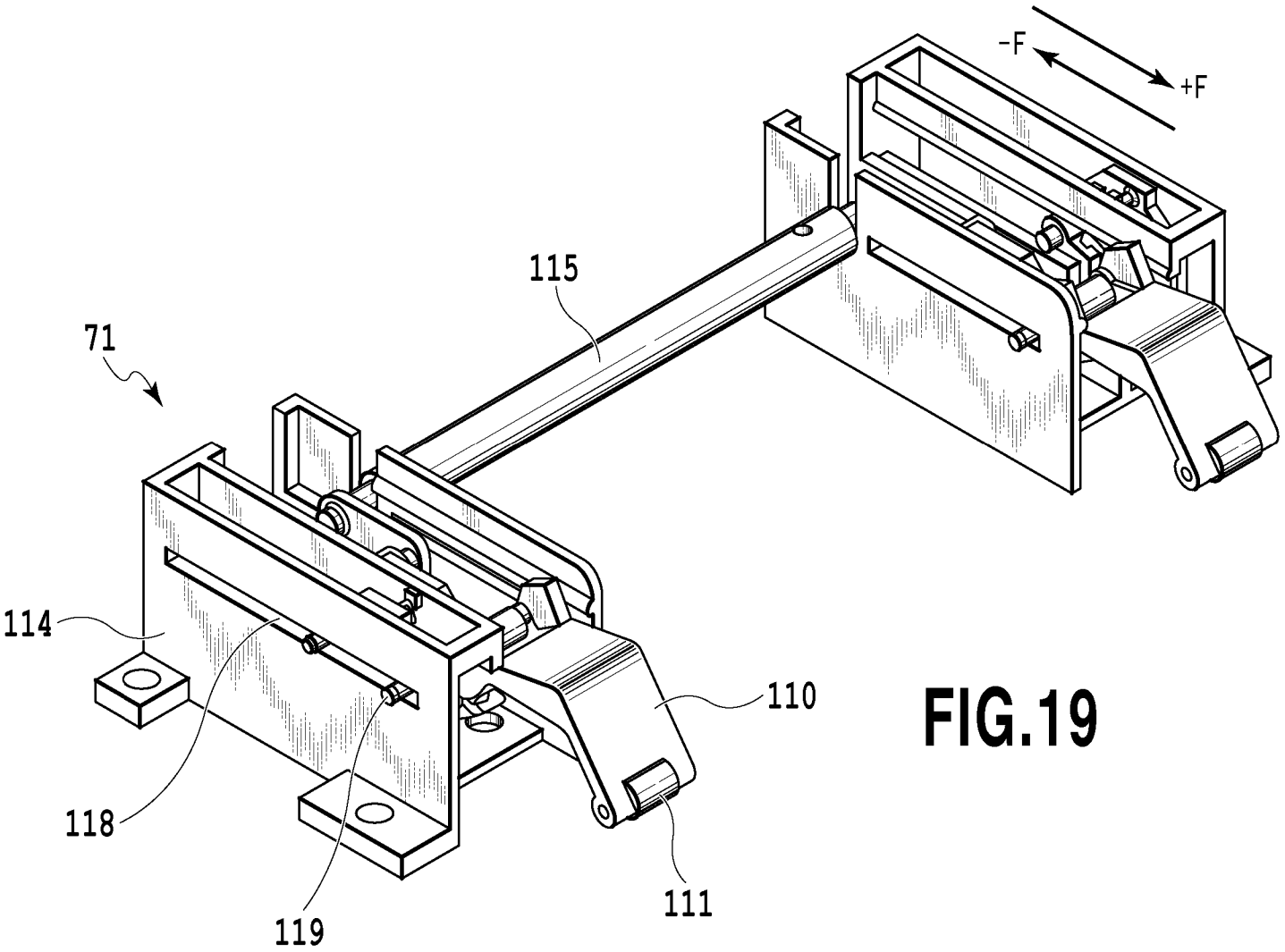
FIG. 19 is a perspective view of a pressing mechanism provided for the printing apparatus in FIG. 18.

The pressing mechanism 71 includes a drive source (not shown), and the link lever 115 (see FIG. 19) is rotated upon receiving the drive force from the drive source. In accordance with the rotation of the link lever 115, the presser members 110 slide, together with the sliders 113 and the latches 112, in the +F direction and the −F direction, along slider grooves 118 of the guide members 114. In order to urge the presser members 110 toward the surface of the preceding sheet P1, members (in this embodiment, springs), although not shown, that apply a biasing force are provided between the presser members 110 and the guide members 114. By the biasing force of the springs, the presser members 110 are pivoted at shafts 119 in a direction indicated by an arrow G1 toward the pressing position.

Figure 23A:
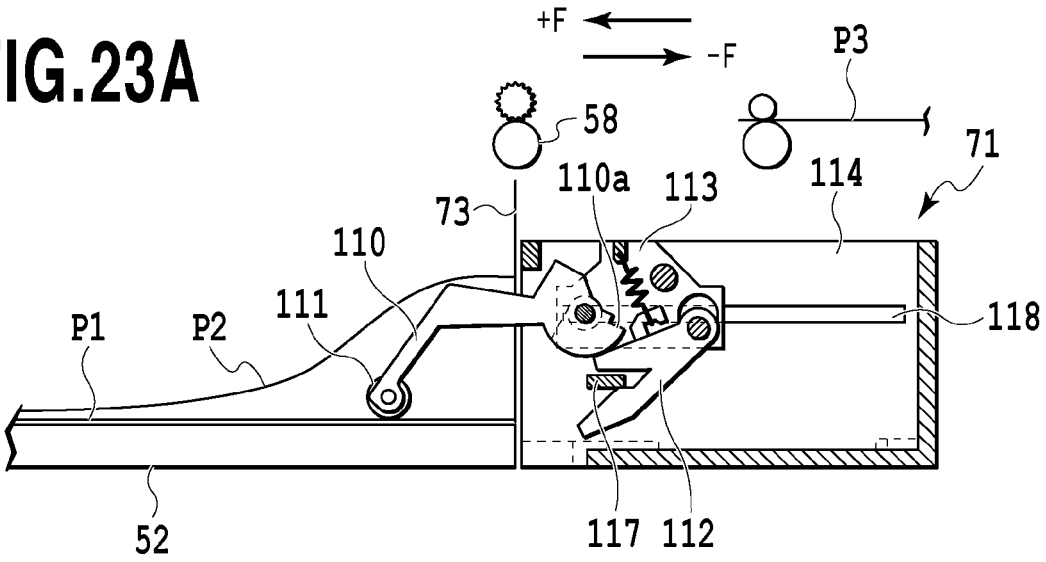
FIGS. 23A and 23B are cross-sectional views of the essential part at stages during discharging of the second sheet.
Figure 23B:
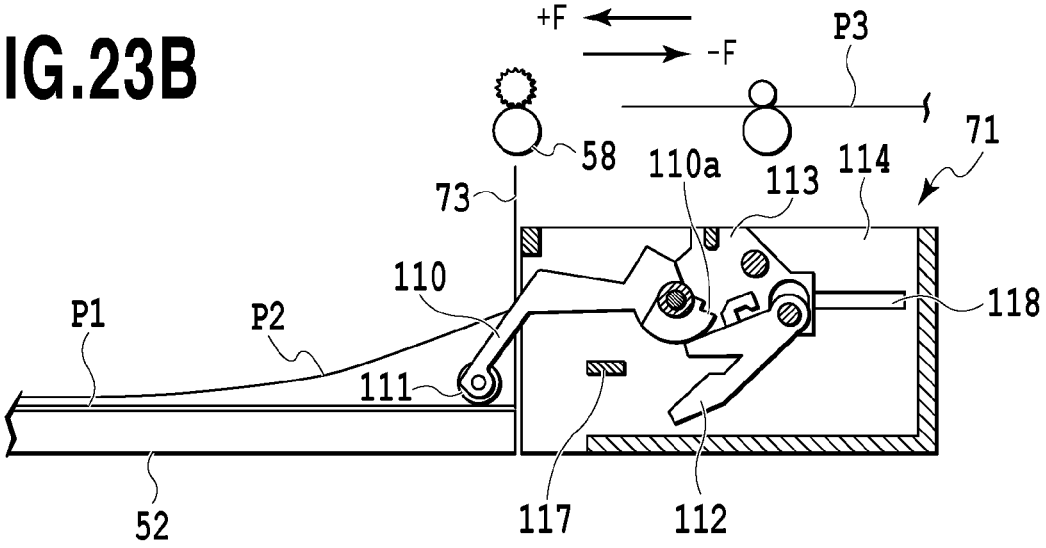
Figure 23C:
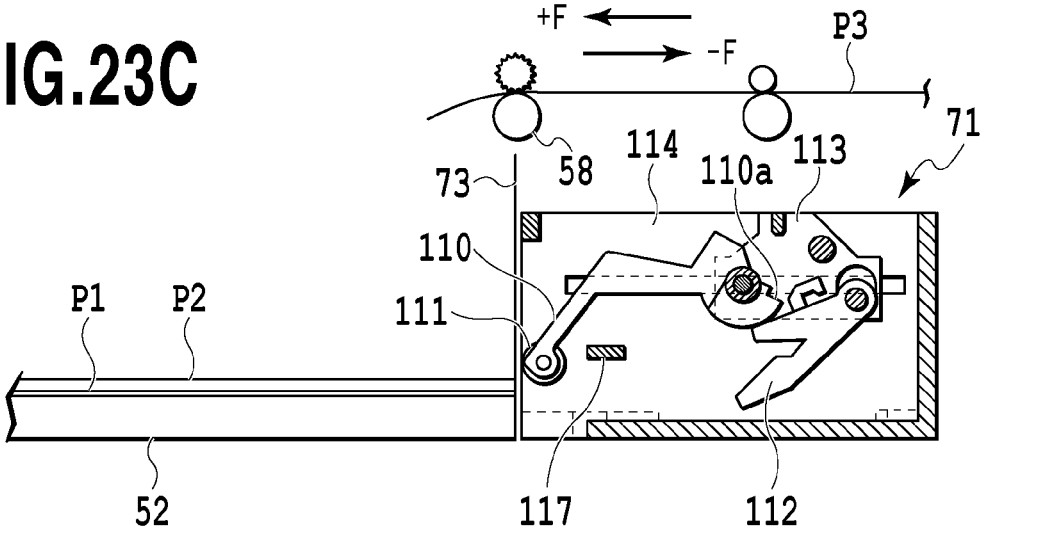
FIG. 23C is a cross-sectional view of the essential part at a stage during discharging of a third sheet.
Figure 24:
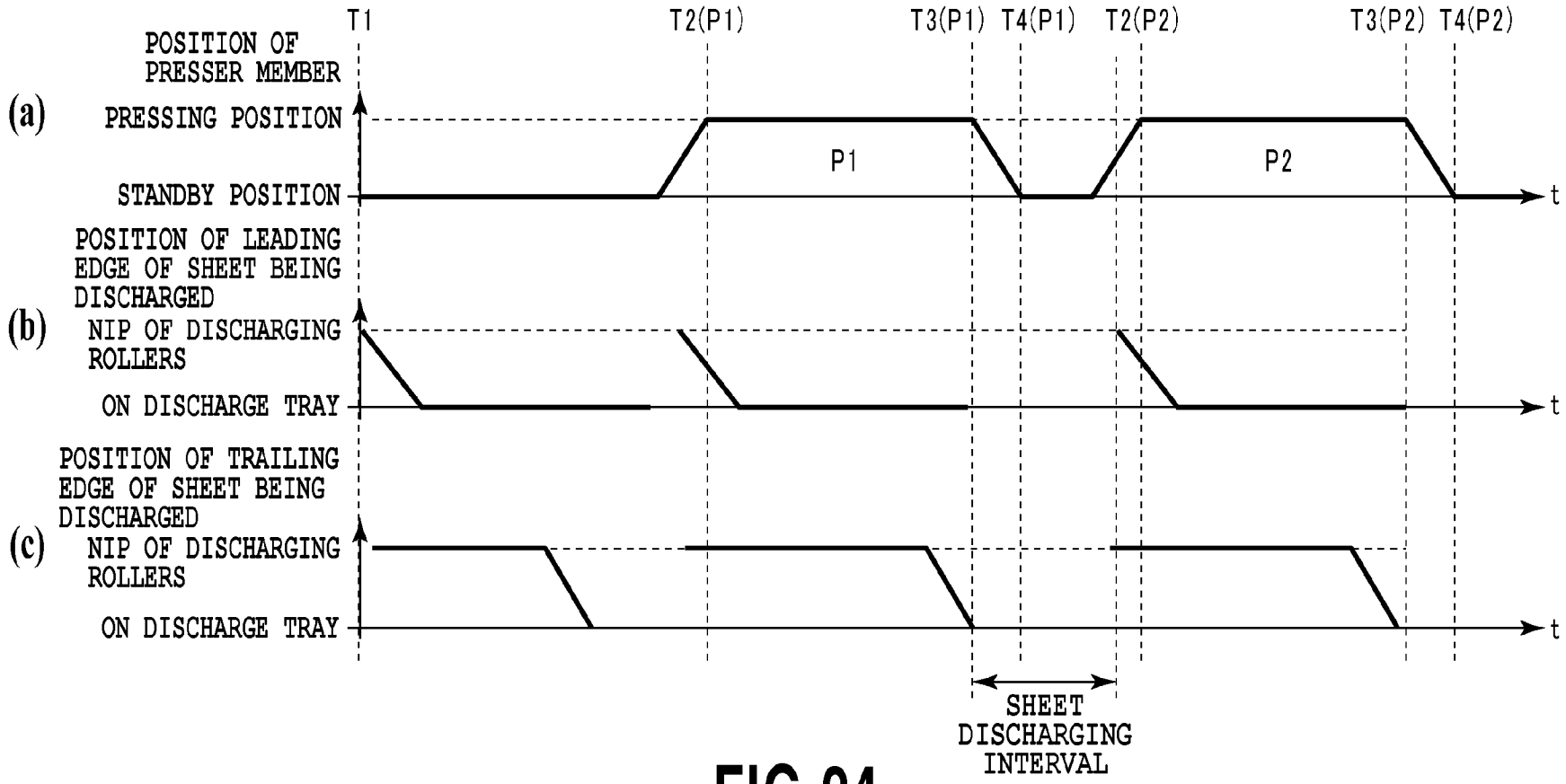
FIG. 24 is a timing chart for explaining the operation of the pressing mechanism.

FIG. 24 is an explanatory chart for the operation timing of the pressing mechanism 71 during the sequential discharging operation for sequentially discharging a plurality of sheets. A part (a) in FIG. 24 represents, as the operation timing of the pressing mechanism 71, a positional change of the presser members 110 due to the movement. A part (b) in FIG. 24 represents a positional change, in the direction of the height, of the leading edge of the sheet that is delivered by the discharging roller pair 58. Apart (c) in FIG. 24 represents a positional change, in the direction of the height, of the trailing edge of the sheet that is delivered by the discharging roller pair 58. As will be described later, in a period from T2(P1) to T3(P1), the presser members 110 are located at the pressing position to hold down the preceding sheet P1, and in a period from T2(P2) to T3(P2), the presser members 110 are located at the pressing position to press the next sheet (the succeeding sheet) P2 together with the preceding sheet P1. The operation of the pressing mechanism 71 will now be described based on FIG. 24 and by referring to FIGS. 20A to 23C.

First, an explanation will be given for the operation performed when, in a period from T1(P1) to T2(P1) in FIG. 24, the presser members 110 move from the initial position to a position above the preceding sheet P on the discharge tray 52 (i.e., the position at which pressing of the sheet is enabled).

Figure 20A:
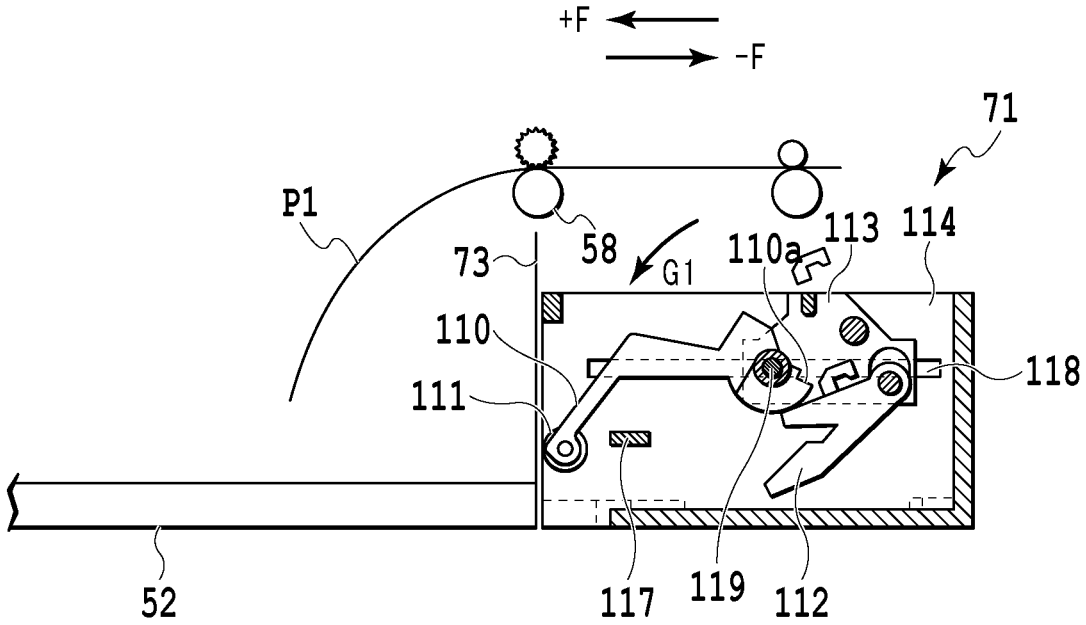
FIGS. 20A and 20B are cross-sectional views of the essential part at the stages during discharging of a first sheet.
Figure 20B:
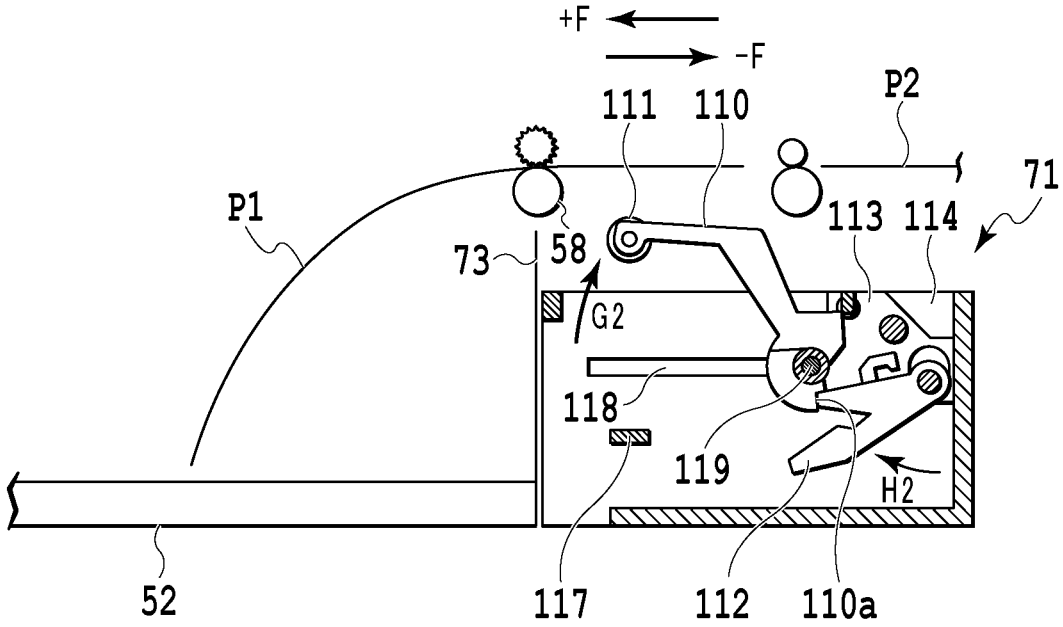
Figure 21A:
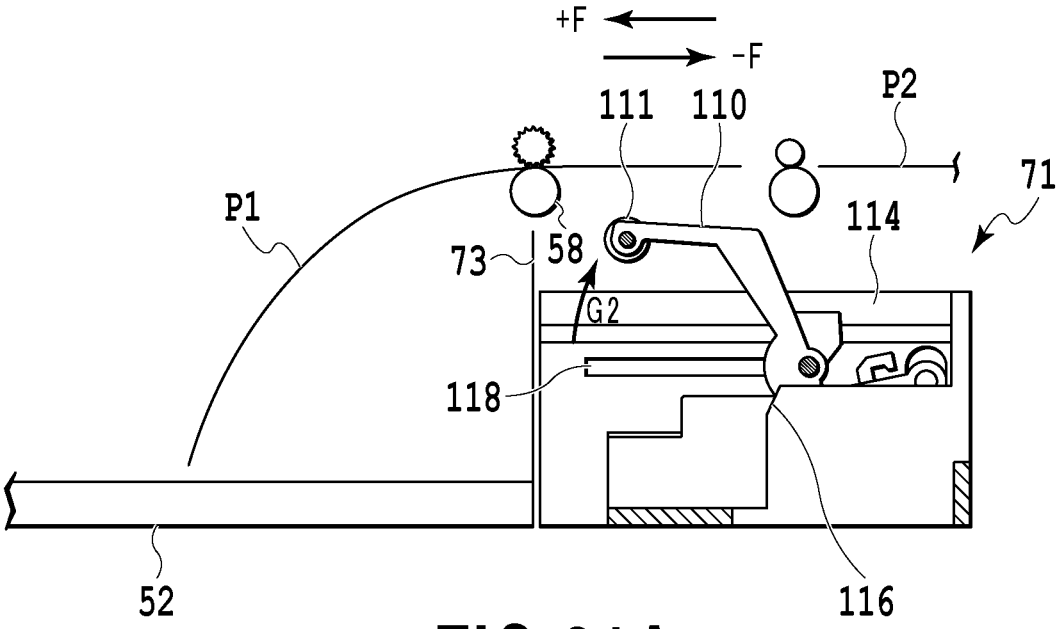
FIG. 21A is a cross-sectional view of the essential part at a stage during discharging of the first sheet.

When the printing apparatus starts printing, the presser members 110 are at the initial position shown in FIG. 20A. Then, as shown in FIG. 20B, the presser members 110 are moved in the −F direction from the initial position, and are also lifted by being pivoted in the direction indicated by an arrow G2. As a result, the presser members 110 are moved from the retraction position (the initial position) to the standby position. In this process, since the base end portions of the presser members 110 contact a cam face 116 of the guide member 114, as shown in FIG. 21A, while the presser members 110 are moving in the −F direction, the presser members 110 are pivoted and lifted in the direction indicated by the arrow G2. When the presser members 110 are lifted in this manner, the latches 112 that are urged in a direction indicated by an arrow H2 are turned in the direction indicated by the arrow H2, as shown in FIG. 20B, and engage notches 110*a* of the presser members 110. As a result, the presser members 110 that are urged by springs (not shown) in the direction indicated by the arrow G1 are locked so as not to pivot in the direction indicated by the arrow G1. Thereafter, in accordance with the rotation of the link lever 115, the presser members 110 locked in this manner are moved in the +F direction from the position shown in FIGS. 20B and 21A to the position shown in FIG. 21B, while the lifted state is maintained.

Next, an explanation will be given for the operation performed when, in a period from T4(P1) to T2(P2) in FIG. 24, the presser members 110 are moved from the standby position shown in FIG. 21B to the pressing position to hold down the preceding sheet P1 that has been discharged on the discharge tray 52.

Figure 21B:
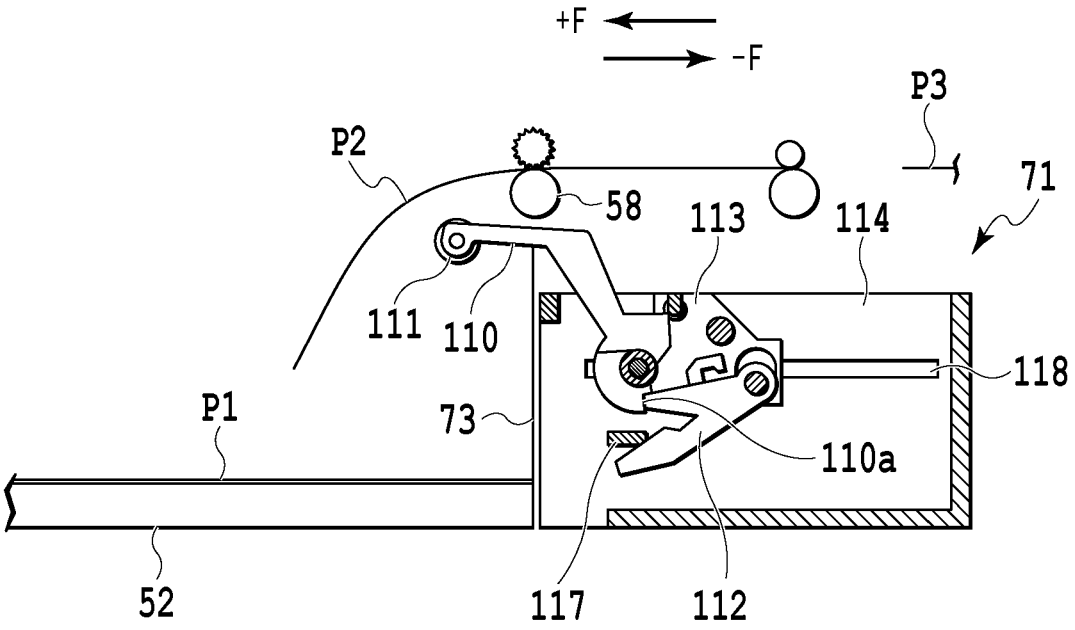
FIG. 21B is a cross-sectional view of the essential part at a stage during discharging of the first and the second sheets.

FIG. 21B is a diagram showing the state wherein, after the discharging of the preceding sheet P1 is completed, the presser members 110 are moved to the position above the preceding sheet P1 (the position at which pressing of the preceding sheet P1 is enabled). Shifting of the presser members 110 to the pressing position is performed in a period since the preceding sheet P1 has been delivered from the nip of the discharging roller pair 58 to the discharge tray 52 until the leading edge of the next sheet (the succeeding sheet) P2 contacts the preceding sheet P1 on the discharge tray 52.

Figure 22A:
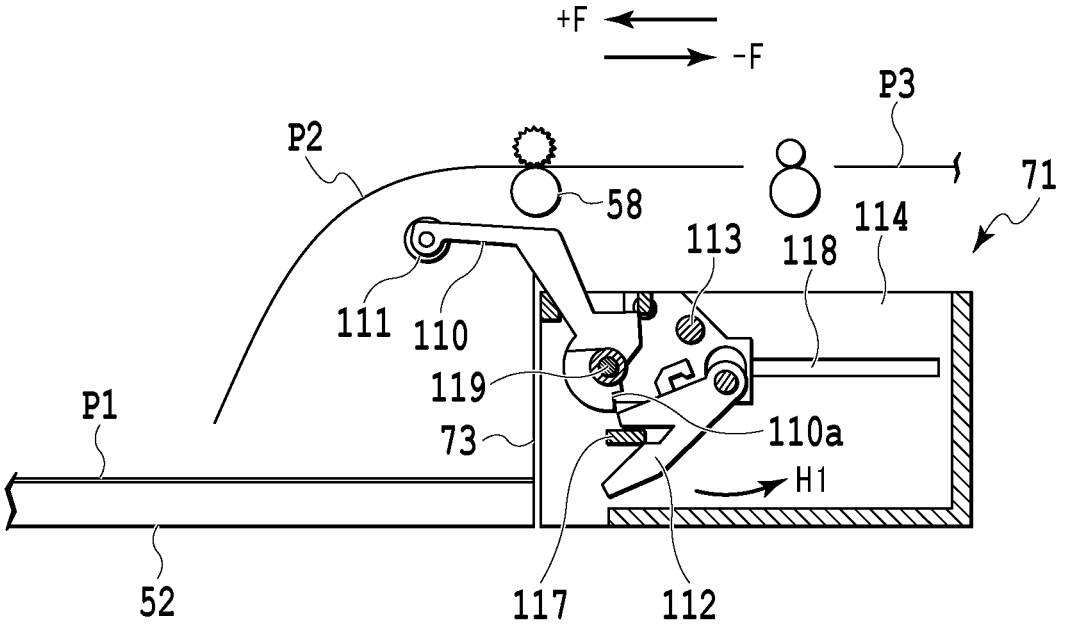
FIGS. 22A and 22B are cross-sectional views of the essential part at stages during discharging of the second sheet.
Figure 22B:
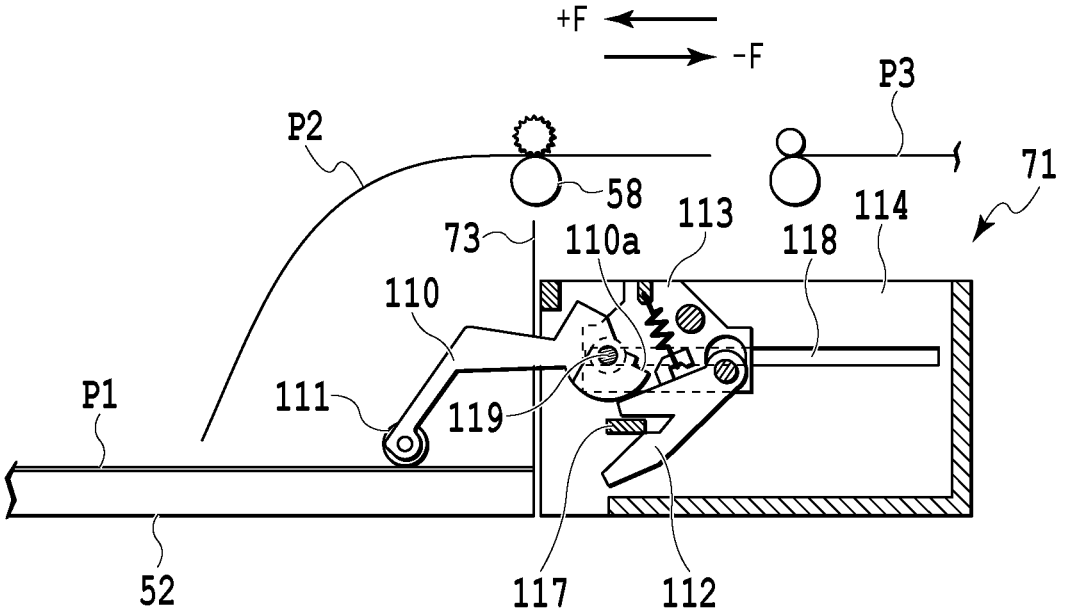

For the movement from such a standby position to the pressing position, first, the presser members 110 that have been moved to the position in FIG. 21B with being locked by the latches 112 so as not to pivot in the direction indicated by the arrow G1 are moved in the +F direction, as shown in FIG. 22A. Then, the latches 112 are brought in contact with latch release portions 117 and are turned in the direction indicated by an arrow H1 to release the presser members 110. As a result, since the presser members 110 are urged by the springs (not shown) in the direction indicated by the arrow G1, the presser members 110 are rotated in the direction indicated by the arrow G1, as shown in FIG. 22B, and at the time of T2(P2) in FIG. 24, reach the pressing position to press the preceding sheet P1. The movement of the presser members 110 to the pressing position is completed before the leading edge of the succeeding sheet P2 abuts upon the preceding sheet P1 on the discharge tray 52, and thereafter, the presser members 110 continue holding down the preceding sheet P1, as shown in FIG. 23, during the discharging of the succeeding sheet P2. As a result, the position of the preceding sheet P1 can be appropriately controlled, so that the position of the preceding sheet P1 will not be deviated in the +F direction due to the contact of the succeeding sheet P2 across the preceding sheet P1.

As described above, until the discharging of the sheet P2 is completed, the presser members 110 are located at the pressing position to hold down the sheet P1 against the discharge tray 52, and prevent the occurrence of the positional deviation of the sheet P1 due to the contact of the sheet P2. The presser members 110 should be moved from the pressing position to the retraction position before the start of discharging the next sheet P3 by the latest.

Subsequently, an explanation will be given for the movement of the presser members 110 from the pressing position to the retraction position in a period from T3 (P1) to T4 (P1) in FIG. 24.

As shown in FIG. 23A, the succeeding sheet P2 is carried on the presser members 110 at the pressing position and discharged by the discharging roller pair 58. When the succeeding sheet P2 is delivered on the presser members 110, the presser members 110 start the retraction movement to move in the −F direction, as shown in FIG. 23B.

When the presser members 110 are moved in the −F direction in this manner, at the time of T4(P1) in FIG. 24 the presser members 110 are drawn back from the discharge tray 52 to the retraction position, as shown in FIG. 23C, and the retraction operation is completed. The start time of the retraction movement (T3(P1)) is defined as the time at which, after the trailing edge of the succeeding sheet P2 has passed the position of the sensor 51 (see FIG. 18), the succeeding sheet P2 is conveyed at a predetermined distance, and is discharged to the discharge tray 52. The start time of the retraction operation can be determined based on the positional relation between the sensor S1 and the discharge tray 52 and a conveyance amount for a unit rotation angle, provided by the conveying roller pair 51 and the discharging roller pair 58. The presser members 110 are moved to be drawn back to the retraction position below the discharging roller pair 58.

When the succeeding sheet P2 has been delivered to the presser members 110 in this manner, the retraction of the presser members 110 is initiated. Even in this case, the presser members 110 are moved horizontally in the −F direction across the surface of the preceding sheet P1, and therefore, the preceding sheet P1 and the succeeding sheet P2 will not be flipped up by the presser members 110.

In this embodiment, since the biasing force is applied to the presser members 110 and the guide member 114 by the springs, the presser members 110 hold down the upper surface of the sheet on the discharge tray 52, while moving from the pressing position to the retraction position. However, in this process, the biasing force exerted to the presser members 110 may be canceled to remove a friction between the presser member 110 and the sheet on the discharge tray 52, and thereafter, the presser members 110 may be moved from the pressing position to the retraction position.

Further, since the rollers 111 are provided for the portions of the presser members 110 that contact the sheet on the discharge tray 52, the rollers 111 are rotated together with the presser members 110 during the retraction operation, so that the friction between the presser members 110 and the sheet on the discharge tray 52 can be reduced. As a result, the misalignment of the sheets stacked on the discharge tray 52 can be suppressed. The ink jet printing apparatus ejects liquid ink to the face of paper (sheet) to form an image, and in a case wherein the retraction of the presser members 110 is started before ink is fixed to the face of paper, ink on the paper might be smeared by the presser members 110, and degradation of the printed image would occur. When the rollers 111 are employed to reduce the friction between the presser members 110 and the sheet on the discharge tray 52, such degradation of an image can be prevented. Further, since the trailing edge of the sheet is brought in contact with a regulator 73, the position of the trailing edge of the sheet can be controlled, and misalignment of the sheets stacked on the discharge tray 52 can be suppressed.

The contact face of the pressing mechanism 71 relative to the sheet and the contact faces of the presser members 110 or the rollers 111 relative to the sheet may have such a shape that the contact area for a unit length is reduced. For example, the surface treatment may be performed for those contact faces to obtain a smaller contact area for a unit length, compared with in a case wherein the surface treatment is not performed. More specifically, particles, such as ceramic particles applied to the surface of the conveying roller 51*a*, may be applied to the contact faces to reduce the sizes of the contact faces.

When the presser members 110 are moved from the retraction position to the pressing position, and from the pressing position to the retraction position, sequential discharging of the sheets can be coped with. In this embodiment, after the sheet has passed the discharging roller pair 58, and has been stacked on the discharge tray 52, and when the presser members 110 have contacted the sheet, the presser members 110 begin to be retracted horizontally across the face of sheet, and therefore, the posture of the sheets on the stack will not be adversely affected. That is, the influence of the retraction timing of the presser members 110 to the alignment of the sheets can be reduced.

Fifth Embodiment

Another example structure for the pressing mechanism will now be described for a fifth embodiment of the present invention, by employing FIGS. 25A to 28B.

Presser members 210 of a pressing mechanism 91 for this embodiment hold down sheets stacked on the discharge tray 52 to urge the sheets toward the discharge tray 52. As will be described later, the presser members 210 include landing portions (placing faces) 210*a*, on which at least one part of the sheet delivered from the nip of the discharging roller pair 58 can be laid, and which are formed almost horizontally. The pressing mechanism 91 includes a drive source (not shown) that moves the presser members 210 in the +F direction and in the −F direction, and members, such as springs, that apply to the presser members 210 a biasing force to hold down the sheet on the discharge tray 52.

Since the presser members 210 are operated at the same timings as those for the presser members 110 in the above described embodiment, no further explanation for the operating timings will be given.

Figure 25A:
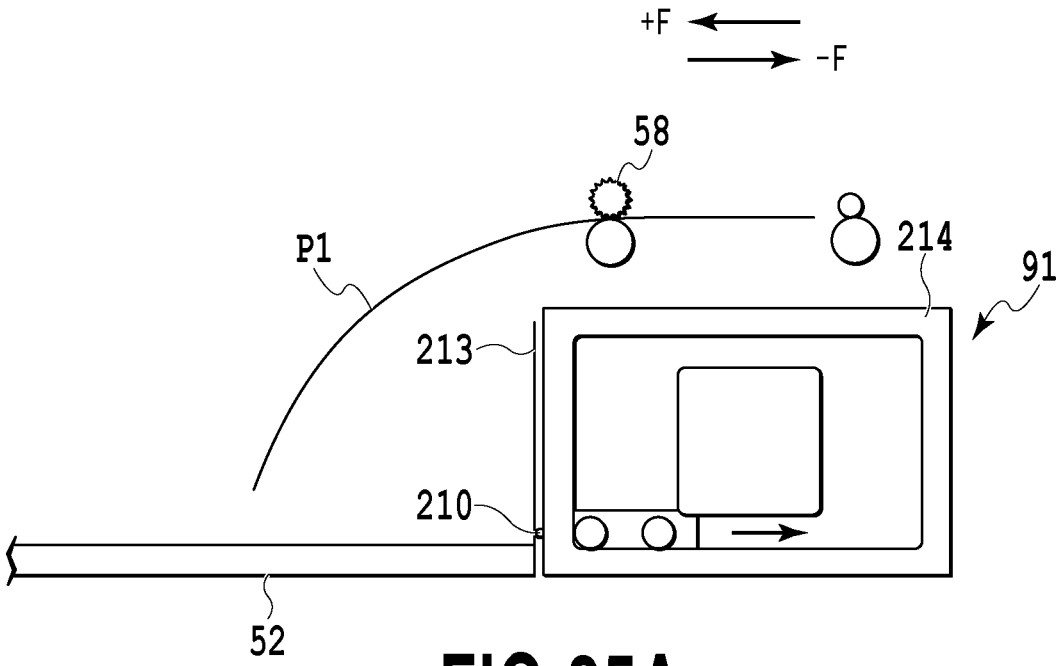
FIGS. 25A and 25B are explanatory diagrams for stages during discharging of a first sheet according to a fifth embodiment of the present invention.
Figure 25B:
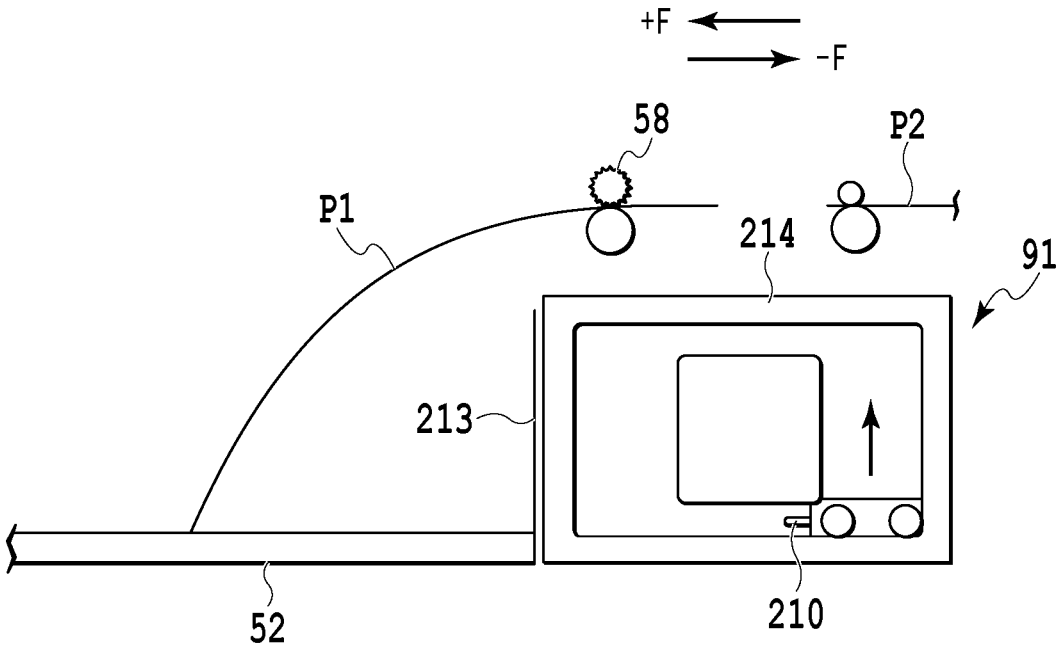
Figure 26A:
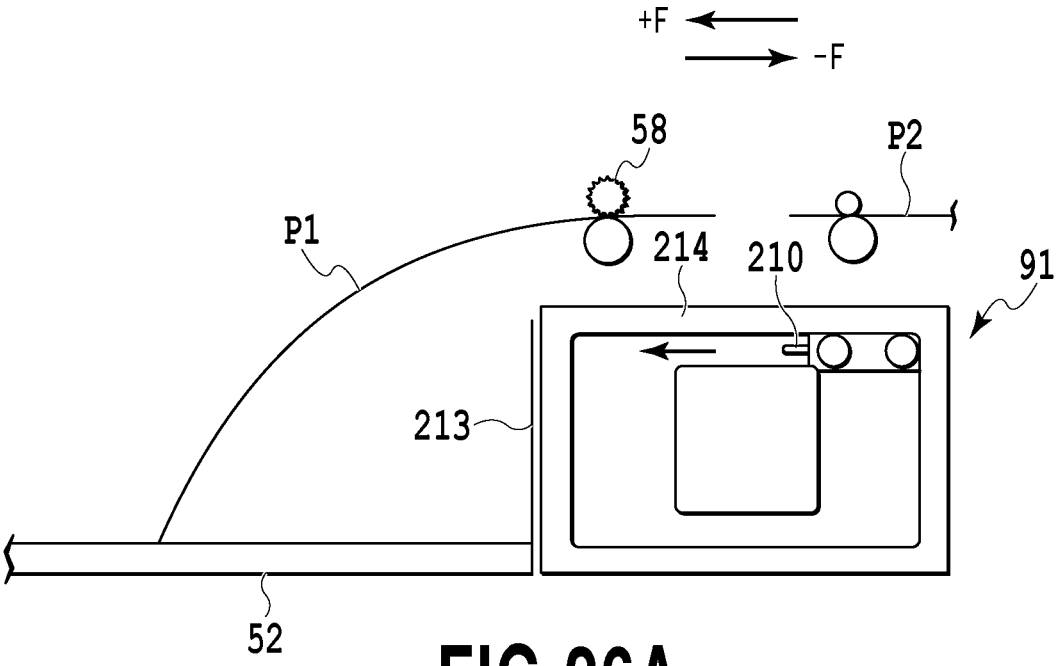
FIG. 26A is an explanatory diagram for a stage during discharging of a first sheet.
Figure 26B:
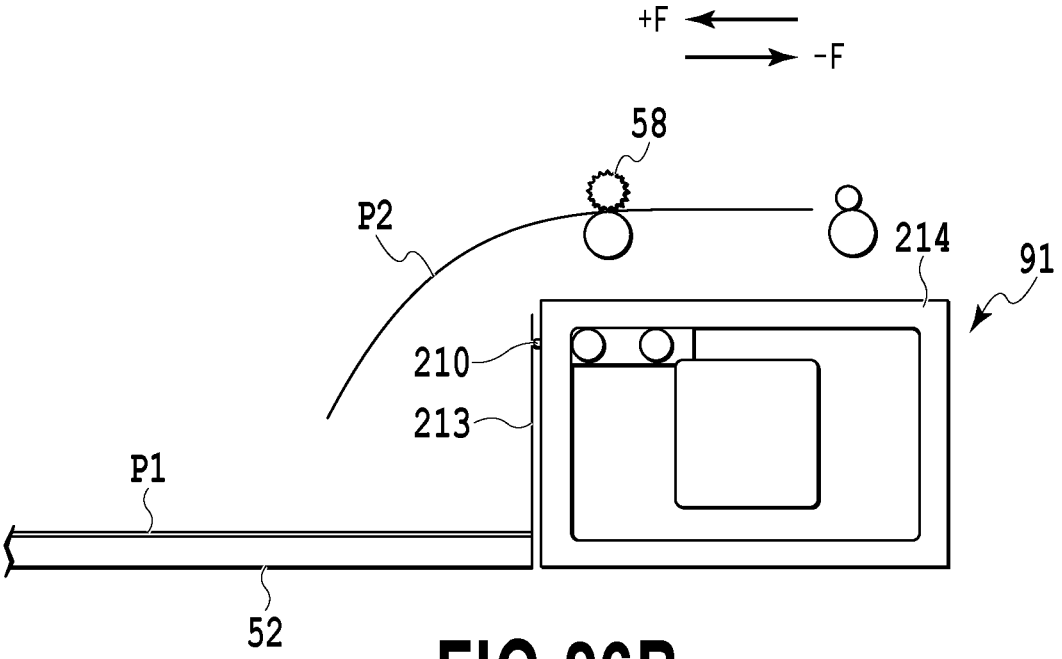
FIG. 26B is an explanatory diagram for a stage during discharging of a second sheet.
Figure 27A:
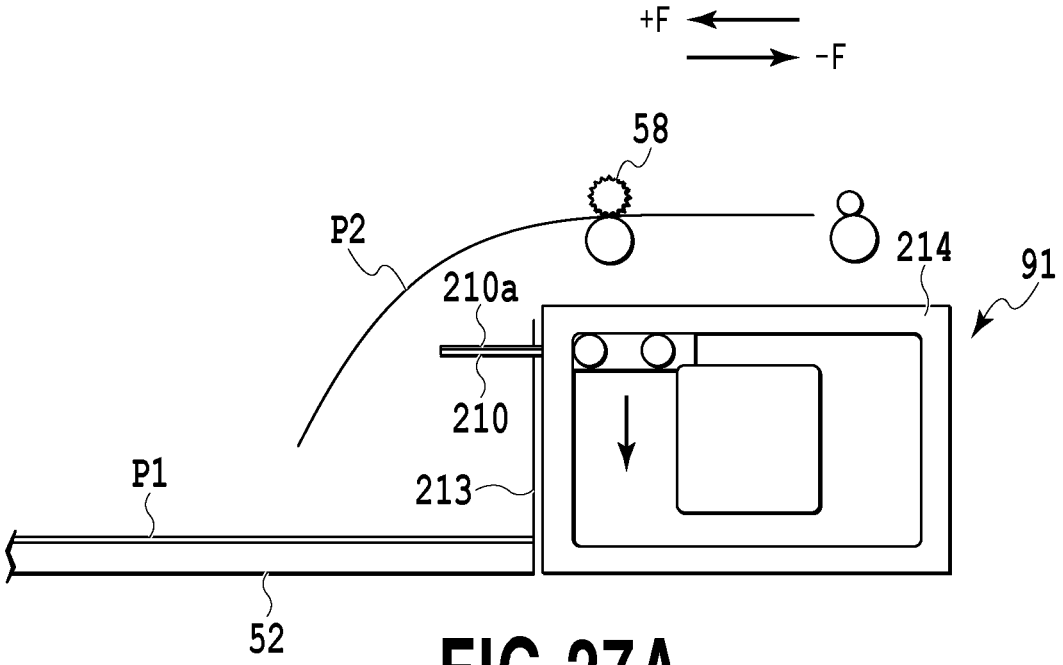
FIGS. 27A and 27B are explanatory diagrams for stages during discharging of the second sheet.
Figure 27B:
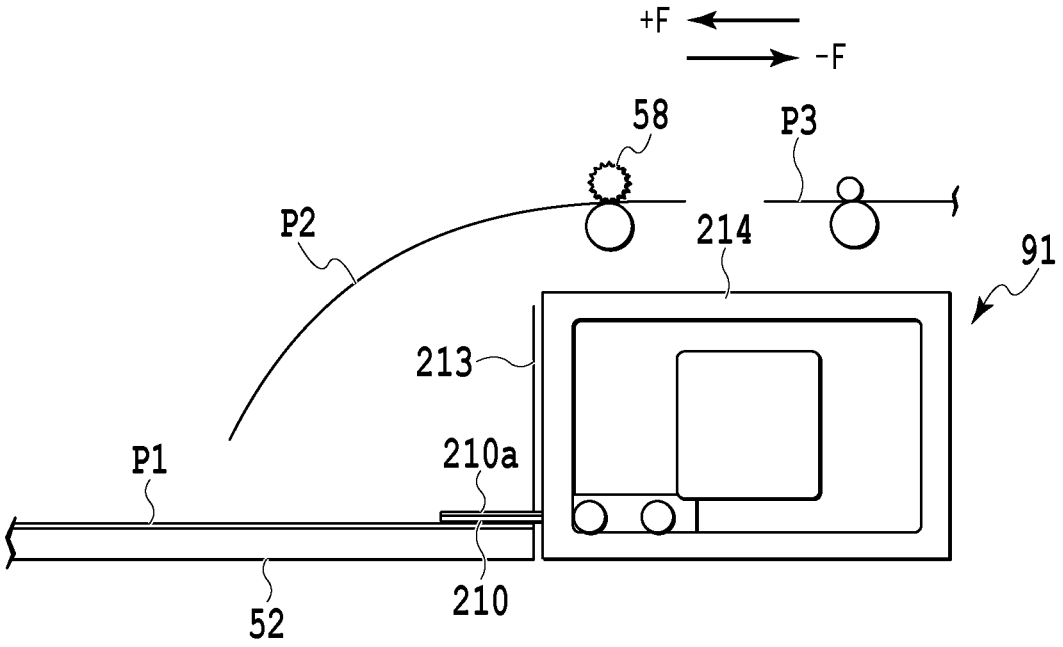

First, when the preceding sheet P1 delivered by the discharging roller pair 58 is discharged to the discharge tray 52, the presser members 210 at an initial position shown in FIG. 25A are moved to a position above the preceding sheet P1, i.e., a position at which pressing of the preceding sheet P1 is enabled. That is, the presser members 210 are moved, by the drive source (not shown), from the initial position in FIG. 25A in the directions indicated by arrows shown in FIGS. 25B, 26A, 26B and 27A, along a guide member 214. Referring to FIG. 27A, after the discharging of the preceding sheet P1 has been completed, the presser members 210 are moved and reach the position above the preceding sheet P1 on the discharge tray, i.e., the position at which pressing of the sheet P1 is enabled.

Thereafter, the presser members 210 are moved, in order to hold down the preceding sheet P1 on the discharge tray 52, from such a standby position shown in FIG. 27A. That is, in a period since the preceding sheet P1 has been discharged to the discharge tray 52 and before the leading edge of the succeeding sheet P2 delivered from the nip of the discharging roller pair 58 contacts the preceding sheet P1 of the discharge tray 52, the presser members 210 are moved to a pressing position in FIG. 27B. For the movement from the standby position to the pressing position, the presser members 210 are moved in the direction indicated by the arrow in FIG. 27A, while holding down the preceding sheet P1 on the discharge tray 52, in a direction perpendicular to the upper face of the sheet P1. Since the presser members 210 press down the preceding sheet P perpendicularly to the upper face, a force to shift the preceding sheet P1 in the +F direction and the −F direction does not occur, and the posture of the sheet will not be deteriorated during the pressing operation of the presser members 210.

Figure 28A:
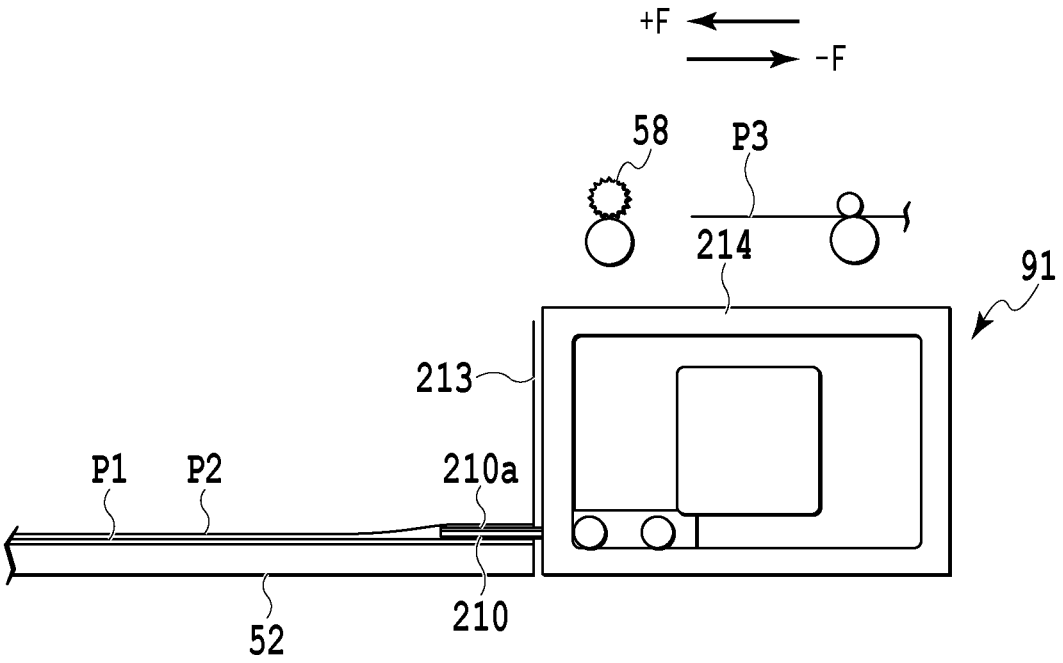
FIGS. 28A and 28B are explanatory diagrams for stages during discharging of a third sheet.
Figure 28B:
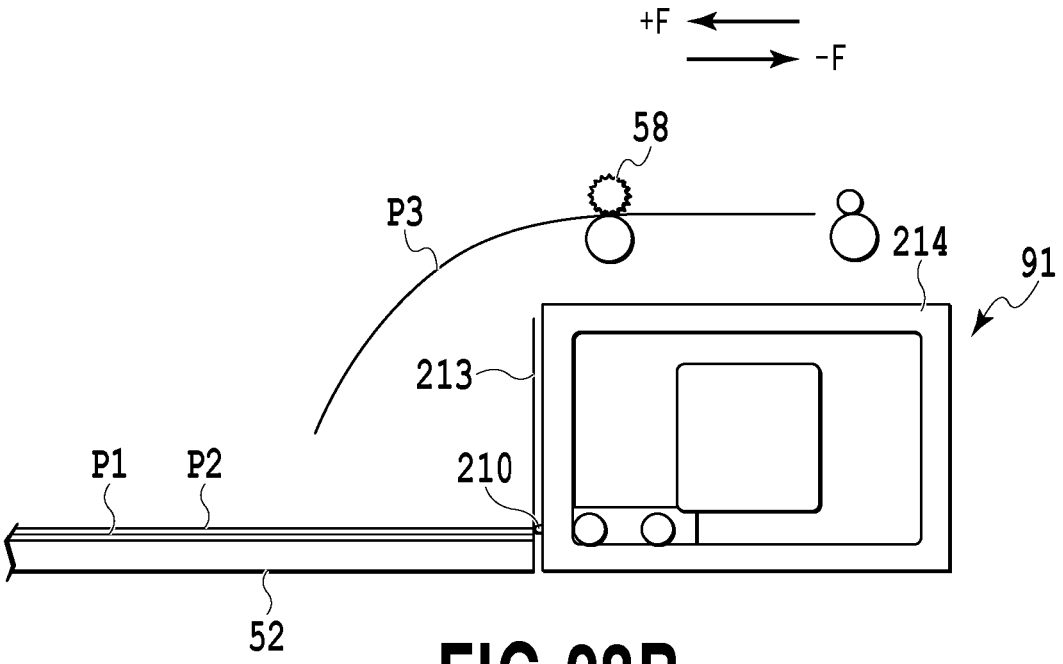

The succeeding sheet P2 is delivered from the discharging roller pair 58 so as to be carried on the presser members 210 at the pressing position, as shown in FIG. 28A. When the succeeding sheet P2 has been delivered to the presser members 210, the presser members 210 are moved in the −F direction along the surface of the preceding sheet P1 (the retraction movement). Through this movement, the presser members 210 are drawn back to the retraction position from the position above the discharge tray 52, as shown in FIG. 28B.

For the presser members 210, the landing portions 210*a* where the succeeding sheet P2 is to land is formed almost horizontally, as shown in FIG. 28A, and is substantially parallel to the upper face of the preceding sheet P1 stacked on the discharge tray 52. As well as the sheet stacking face of the discharge tray 52, the landing portions 210*a* are formed almost horizontally, without any inclination. Therefore, when the succeeding sheet P2 has landed on the landing portions 210*a*, and when retraction of the presser members 210 is started, a force to deviate the succeeding sheet P2 does not occur. Furthermore, since the landing portions 210*a* are provided almost horizontally, when the sheet has been delivered and carried on the presser members 210, slipping off of the sheet is suppressed, and the degradation of the posture of the sheet can be more appropriately suppressed.

OTHER EMBODIMENTS

The number of presser members employed to hold down the sheet on the discharge tray may be only one, or three or more. It is desirable that the presser member be located at the position at which the portion of the sheet that tends to be curled can be held down.

The sheet stacking device of this invention can employ various types of sheets, other than the sheets on which images are printed by the printing apparatus. Further, this sheet stacking device can be employed together with, or separately from, various apparatuses, other than the printing apparatus, and the common use of a control device for these apparatus is also available.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-035850, filed Feb. 26, 2014 which is hereby incorporated by reference wherein in its entirety.

What is claimed is:

1. A sheet stacking device comprising:

a discharge tray configured to receive sheets that are discharged;

a presser member configured to be able to hold down the sheets stacked on the discharge tray; and a moving unit configured to move the presser member between a pressing position at which the presser member holds down the sheets stacked on the discharge tray and a retraction position at which the presser member is separated from the discharge tray, wherein the moving unit (a) positions the presser member at the pressing position while a sheet is discharged, and (b) moves the presser member to the retraction position from the pressing position along a stacking face of the discharge tray after discharging of the sheet is completed.

2. The sheet stacking device according to claim 1, further comprising a tray moving unit configured to move the discharge tray in a predetermined direction so as to sort sheets that are sequentially discharged, and wherein the tray moving unit moves the presser member together with the discharge tray.

3. The sheet stacking device according to claim 1, wherein a plurality of sheets discharged sequentially are stacked on the discharge tray, and wherein the presser member holds down a trailing edge portion of the stacked sheets from above.

4. The sheet stacking device according to claim 3, wherein the presser member holds the trailing edge portion at both sides of the sheet in a widthwise direction of the sheet.

5. The sheet stacking device according to claim 1, wherein the moving unit moves the presser member to the retraction position from the pressing position along the stacking face of the discharge tray after discharging of the sheet is completed and a part of the sheet is laid.

6. The sheet stacking device according to claim 1, wherein the presser member has a roller that contacts the sheet stacked on the discharge tray.

7. The sheet stacking device according to claim 1, wherein the presser member has a placing face on which one part of the sheet is to be laid, the placing face being inclined relative to the stacking face of the discharge tray.

8. The sheet stacking device according to claim 1, wherein the presser member has a placing face on which a part of the sheet is to be laid, the placing face being extended in parallel to the stacking face of the discharge tray.

9. The sheet stacking device according to claim 1, wherein the sheets are individually discharged.

10. A printing apparatus, which prints images on sheets, and sequentially discharges, to a sheet stacking device, the sheets on which the images are printed, wherein the sheet stacking device comprises:

a discharge tray configured to receive sheets that are discharged;

a presser member configured to be able to hold down the sheets stacked on the discharge tray; and a moving unit configured to move the presser member between a pressing position at which the presser member holds down the sheets stacked on the discharge tray and a retraction position at which the presser member is separated from the discharge tray, wherein the moving unit (a) positions the presser member at the pressing position while a sheet is discharged, and (b) moves the presser member to the retraction position from the pressing position along a stacking face of the discharge tray after discharging of the sheet is completed.

* * * * *